US010365601B2

(12) United States Patent
Sone et al.

(10) Patent No.: US 10,365,601 B2
(45) Date of Patent: Jul. 30, 2019

(54) IMAGE FORMING APPARATUS AND IMAGE FORMING METHOD

(71) Applicant: RICOH COMPANY, Ltd., Ohta-Ku (JP)

(72) Inventors: Keita Sone, Tokyo (JP); Akira Yoshida, Tokyo (JP); Natsumi Matsue, Kanagawa (JP); Kazuaki Kamihara, Tokyo (JP); Yuuichiroh Uematsu, Kanagawa (JP); Kohei Matsumoto, Kanagawa (JP); Taku Kumiya, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/793,016

(22) Filed: Oct. 25, 2017

(65) Prior Publication Data

US 2018/0150010 A1 May 31, 2018

(30) Foreign Application Priority Data

Nov. 25, 2016 (JP) ..... 2016-228496
Feb. 28, 2017 (JP) ..... 2017-035897

(51) Int. Cl.
*G03G 9/08* (2006.01)
*G03G 15/16* (2006.01)
*G03G 15/00* (2006.01)

(52) U.S. Cl.
CPC ..... *G03G 15/5041* (2013.01); *G03G 9/0827* (2013.01); *G03G 15/1655* (2013.01);
(Continued)

(58) Field of Classification Search
CPC ..... G03G 15/1655; G03G 15/5041; G03G 15/5058; G03G 15/55; G03G 2215/0164;
(Continued)

(56) References Cited

U.S. PATENT DOCUMENTS 9,204,012 B2 * 12/2015 Furukawa ..... H04N 1/60
2008/0075476 A1 3/2008 Nakazato et al.
(Continued)

FOREIGN PATENT DOCUMENTS

JP 2008-102474 A 5/2008
JP 2012-141397 A 7/2012
(Continued)

*Primary Examiner* — Negussie Worku
(74) *Attorney, Agent, or Firm* — Xsensus LLP

(57) ABSTRACT

An image forming apparatus includes an image forming device, an image density detector, and a processor. The processor controls the image forming device to form a first test toner image, and controls the image density detector to detect an image density at the plurality of positions of the first test toner image. The processor adjusts an image forming condition so that the image density detected at each of the plurality of positions becomes a target image density, controls the image forming device to form a second test toner image based on the adjusted image forming condition, controls the image density detector to detect an image density at the plurality of positions of the second test toner image, determines whether a streak exists in the second test toner image based on the detected image densities, and executes a countermeasure to prevent an occurrence of the streak.

16 Claims, 15 Drawing Sheets

(52) U.S. Cl.
CPC ..... *G03G 15/5058* (2013.01); *G03G 15/55* (2013.01); *G03G 2215/0164* (2013.01)

(58) Field of Classification Search
CPC ..... G03G 9/0827; G03G 15/1605; G03G 15/5054; G03G 15/0131; G03G 15/1665; G03G 15/1675; G03G 2215/00059; G03G 2215/00063; G03G 2215/0129; G03G 15/0233; G03G 15/0266; G03G 15/0291; G03G 15/5016; G03G 15/5037; G03G 15/5062; H04N 1/02885; H04N 1/047; H04N 1/00015; H04N 1/00031; H04N 1/00082; H04N 1/60; H04N 1/6033; H04N 1/6041
USPC ..... 358/1.15; 399/301, 302, 49, 66
See application file for complete search history.

(56) References Cited

U.S. PATENT DOCUMENTS

2009/0296147 A1* 12/2009 Kinukawa ..... G03G 15/1605 358/1.15
2009/0297190 A1* 12/2009 Kinukawa ..... G03G 15/1605 399/49
2013/0156449 A1* 6/2013 Fujimori ..... G03G 15/55 399/44
2014/0270818 A1* 9/2014 Tanaka ..... G03G 15/0856 399/27
2014/0294412 A1* 10/2014 Tanaka ..... G03G 15/5058 399/49
2016/0077468 A1* 3/2016 Kojima ..... G03G 15/1665 399/66
2016/0103408 A1 4/2016 Sone et al.
2016/0246220 A1 8/2016 Sone et al.
2016/0349687 A1* 12/2016 Mori ..... G03G 15/5041
2017/0108809 A1* 4/2017 Itoh ..... G03G 15/5054
2017/0131670 A1* 5/2017 Ino ..... G03G 15/0178
2017/0153564 A1* 6/2017 Kanaya ..... G03G 15/0266
2017/0269527 A1* 9/2017 Kaneko ..... G03G 15/5025
2018/0046122 A1* 2/2018 Kitajima ..... G03G 15/0233
2018/0150010 A1* 5/2018 Sone ..... G03G 15/5058
2018/0288236 A1* 10/2018 Tomii ..... H04N 1/00031
2018/0292776 A1* 10/2018 Ino ..... G03G 15/5058
2019/0049872 A1* 2/2019 Mori ..... G03G 15/0126

FOREIGN PATENT DOCUMENTS

JP 2012-237874 A 12/2012
JP 2013-183229 A 9/2013
JP 2014-134673 A 7/2014
JP 2015-132642 A 7/2015
JP 2016-114844 A 6/2016

* cited by examiner

IMAGE FORMING APPARATUS AND IMAGE FORMING METHOD

CROSS-REFERENCE TO RELATED APPLICATIONS

This patent application is based on and claims priority pursuant to 35 U.S.C. § 119 to Japanese Patent Application Nos. 2016-228496, filed on Nov. 25, 2016 and 2017-035897, filed on Feb. 28, 2017, in the Japanese Patent Office, the entire disclosures of which are hereby incorporated by reference herein.

BACKGROUND

Technical Field

Embodiments of the present invention generally relate to an image forming apparatus, such as a copier, a printer, a facsimile machine, or a multifunction peripheral having at least two of copying, printing, facsimile transmission, plotting, and scanning capabilities, and an image forming method.

Background Art

Some image forming apparatuses detect image density of a test toner image formed by their image forming units, determine whether a streaked image occurs, and execute some sort of countermeasure to prevent occurrence of the streaked image.

SUMMARY

This specification describes an improved image forming apparatus, which, in one illustrative embodiment, includes an image forming device, image density detector, and a processor. The image forming device forms a first test toner image and a second test toner image. The image density detector detects an image density at a plurality of positions of the first test toner image and the second test toner image formed by the image forming device. The processor controls the image forming device to form the first test toner image, controls the image density detector to detect the image density at the plurality of positions of the first test toner image, adjusts an image forming condition of the image forming device so that the image density at each of the plurality of positions becomes a target image density, controls the image forming device to form a second test toner image based on the adjusted image forming condition, controls the image density detector to detect the image density at the plurality of positions of the second test toner image, determines whether a streaked image exists in the second test toner image based on the image density detected at the plurality of positions of the second test toner image by the image density detector, and executes a countermeasure to prevent an occurrence of the streaked image based on a determined result of the streaked image in the second test toner image.

This specification further describes an improved image forming method that includes forming a first test toner image, detecting an image density at a plurality of positions of the first test toner image, adjusting an image forming condition so that the image density at each of the plurality of positions of the first test toner image becomes the target image density, forming a second test toner image based on the adjusted image forming condition, detecting an image density at the plurality of positions of the second test toner image, determining whether a streaked image exists in the second test toner image based on the image density detected at the plurality of positions of the second test toner image, and executing a countermeasure to prevent an occurrence of the streaked image based on a determined result of the streaked image in the second test toner image.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

DETAILED DESCRIPTION

Figure 1:
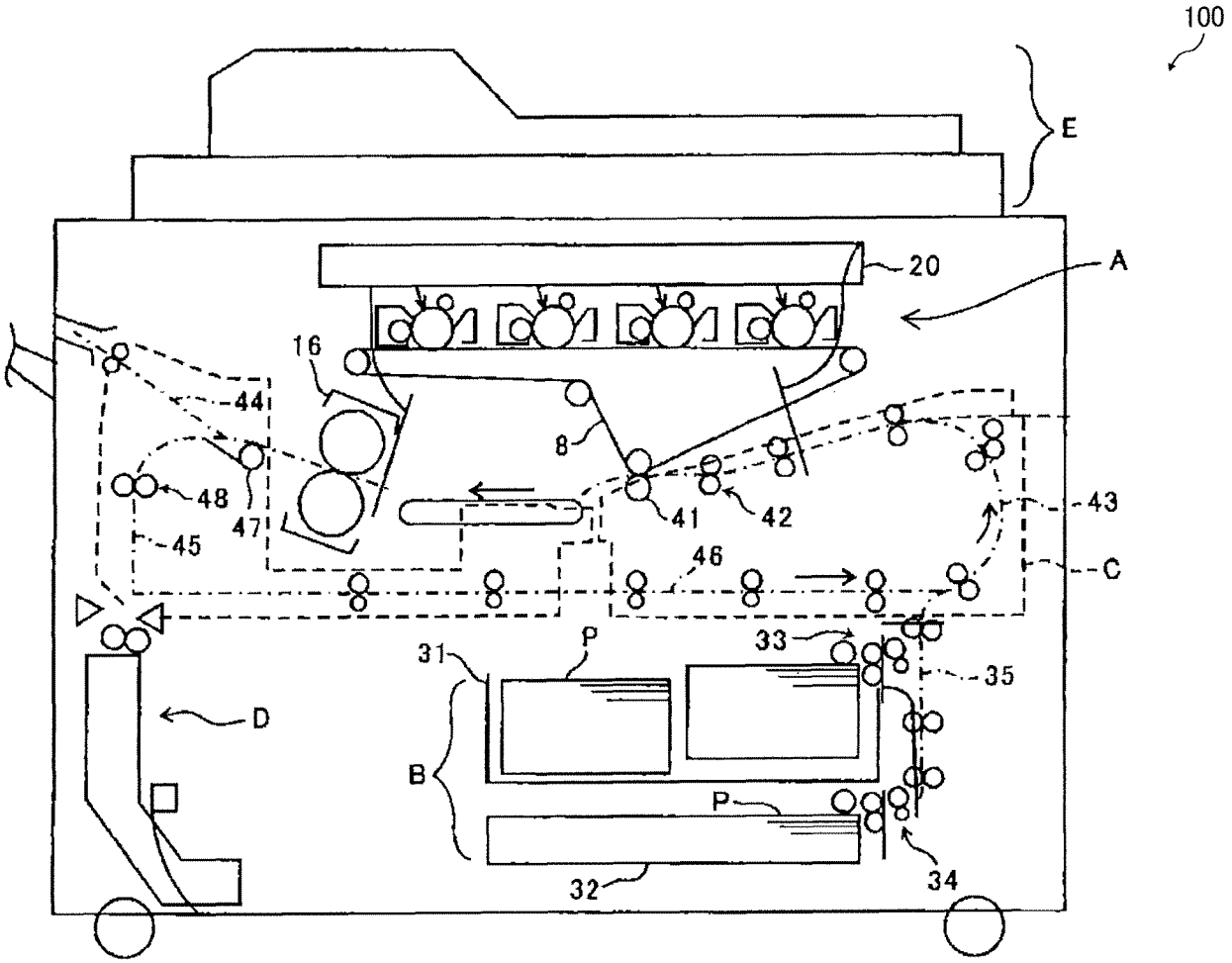
FIG. 1 is a schematic view of an image forming apparatus according to an embodiment of the present disclosure.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Referring now to the drawings, wherein like reference numerals designate identical or corresponding parts throughout the several views thereof, and particularly to FIG. 1, an image forming apparatus 100 employing electrophotography, according to an embodiment of the present invention is described.

As used herein, the singular forms "a", "an", and "the" are intended to include the plural forms as well, unless the context clearly indicates otherwise.

It is to be noted that the suffixes Y, M, C, and K attached to each reference numeral indicate only that components indicated thereby are used for forming yellow, magenta, cyan, and black images, respectively, and hereinafter may be omitted when color discrimination is not necessary.

A description is provided of an embodiment of the image forming apparatus 100 according to the present disclosure. A basic structure of the image forming apparatus 100 will be firstly described. FIG. 1 is a schematic view illustrating the image forming apparatus 100 according to the embodiment. FIG. 1 illustrates the image forming apparatus 100 viewed from its front side; In FIG. 1, the image forming apparatus 100 includes a printing device A, a sheet feeder B, a sheet conveyance device C, a switchback device D, and an image scanner E.

Figure 2:
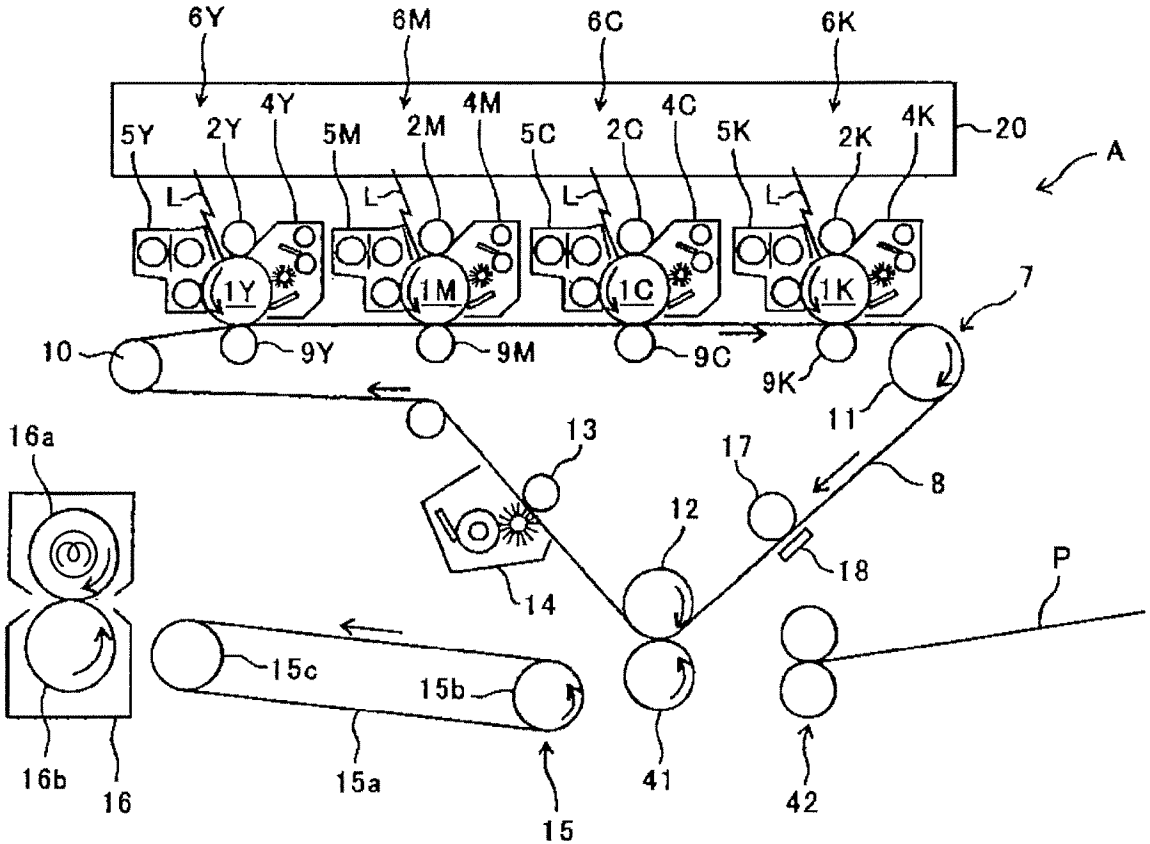
FIG. 2 is a schematic view of a printing device incorporated in the image forming apparatus illustrated in FIG. 1.

FIG. 2 is a schematic view of the printing device A to form an image on a recording sheet. The printing device A includes process units 6Y, 6M, 6C, and 6K for forming yellow, magenta, cyan, and black toner images, respectively. Above the process units 6Y, 6M, 6C, and 6K, an optical writing unit 20 is disposed. The optical writing unit 20 irradiates the surfaces of the photoconductors 1Y, 1M, 1C, and 1K with laser beams L to write electrostatic latent images thereon optically.

Below the process units 6Y, 6M, 6C, and 6K, a transfer unit 7 is disposed. The transfer unit 7 includes an intermediate transfer belt 8 formed in an endless loop, support rollers disposed inside the endless loop, a tension roller disposed outside the endless loop, a belt cleaner 14, an image density sensor 18, and a secondary-transfer facing roller 41. The support rollers disposed inside the endless loop are primary transfer rollers 9Y, 9M, 9C, and 9K, a driven roller 10, a driving roller 11, a secondary-transfer roller 12, a cleaning-backup rollers 13, and a detection position roller 17.

A driving device rotates the driving roller 11 in the clockwise direction in FIG. 1, and the rotation of the driving roller 11 enables the intermediate transfer belt 8 to rotate in the same direction.

The intermediate transfer belt 8 is nipped between the photoconductors 1Y, 1M, 1C, and 1K and the primary transfer rollers 9Y, 9M, 9C, and 9K disposed inside the loop of the intermediate transfer belt 8. Accordingly, the outer surface of the intermediate transfer belt 8 contacts the photoconductors 1Y, 1M, 1C, and 1K, and the contact portions therebetween serve as primary transfer nips for yellow, magenta, cyan, and black, respectively. To each of the primary transfer rollers 9Y, 9M, 9C, and 9K, a primary transfer power supply applies a primary transfer bias, which is opposite in polarity from the toner. Accordingly, a primary transfer electric field that electrostatically transfers toner from the photoconductors 1Y, 1M, 1C, and 1K, respectively, to the intermediate transfer belt 8 is produced at each of the four primary transfer nips for yellow, magenta, cyan, and black.

The secondary-transfer facing roller 41 is disposed below the intermediate transfer belt 8. The secondary-transfer facing roller 41 contacts a portion of the outer surface or the image bearing surface of the intermediate transfer belt 8 wound around the secondary-transfer roller 12, thereby forming a secondary-transfer nip between the secondary-transfer facing roller 41 and the intermediate transfer belt 8. To the secondary-transfer roller 12, a secondary-transfer power supply applies a secondary-transfer bias, which is same in polarity of the toner. On the other hand, the secondary-transfer facing roller 41 is electrically ground. With this configuration, a secondary-transfer electric field is formed between the secondary-transfer roller 12 and the secondary-transfer facing roller 41 in the secondary-transfer nip so that the toner moves electrostatically from the outer surface of the intermediate transfer belt 8 to a recording medium P sandwiched between the intermediate transfer belt 8 and the secondary-transfer facing roller 41.

The process units 6Y, 6M, 6C, and 6K are similar in configuration except that the color of toner used therein is different. Taking the process unit 6Y that forms the yellow toner image as an example, the process unit 6Y includes a charger 2Y, a developing device 5Y, a photoconductor cleaner 4Y, and a charge removing device around the drum-shaped photoconductor 1Y serving as a latent image bearer.

The charger 2Y uniformly charges a surface of the photoconductor 1Y that rotates counterclockwise in FIG. 2 to a high potential of the same polarity of the toner. The uniformly charged surface of the photoconductor 1Y is scanned by laser light L, thereby forming an electrostatic latent image for yellow on the surface of the photoconductor 1Y. The developing device 5Y contains developer including yellow toner and magnetic carrier, develops the electrostatic latent image by using the developer, and forms the yellow toner image. The yellow toner image formed on the photoconductor 1Y enters the primary transfer nip for the yellow with rotation of the photoconductor 1Y. In the primary transfer nip, the yellow toner image is primarily transferred from the photoconductor 1Y onto the outer surface of the intermediate transfer belt 8 by the primary transfer electric field and pressure. A residual toner that is not transferred to the intermediate transfer belt 8 adheres to the surface of the photoconductor 1Y after the surface of the photoconductor 1Y passes through the primary transfer nip The photoconductor cleaner 4Y removes the residual toner from the surface of the photoconductor 1Y.

The description above concerns formation of yellow images in the process unit 6Y for yellow. In the process units 6M, 6C, and 6K, magenta, cyan and black toner images are formed on the photoconductors 1M, 1C, and 1K, respectively, through similar electrophotographic processes.

The intermediate transfer belt 8 sequentially passes the primary transfer nips for yellow, magenta, cyan, and black as the intermediate transfer belt 8 rotates in the clockwise direction in FIG. 2. In the primary transfer nips, yellow, magenta, cyan, and black toner images are sequentially primarily transferred from the photoconductors 1Y, 1M, 1C, and 1K and superimposed on the intermediate transfer belt 8. Thus, a four-color superimposed toner image is formed on the outer surface of the intermediate transfer belt 8.

The four-color superimposed toner image is transported to the secondary-transfer nip as the intermediate transfer belt 8 rotates. A pair of registration rollers 42 of the sheet conveyance device C that is described later is positioned on the right of the secondary-transfer nip in FIG. 2. A recording sheet P is transported to a registration nip between the pair of the registration rollers 42, timed to coincide with the four-colored superimposed toner image formed on the intermediate transfer belt 8. The pair of registration rollers 42 starts to rotate to feed the recording sheet P to the secondary-transfer nip in appropriate timing such that the recording sheet P is aligned with the four-colored superimposed toner image formed on the intermediate transfer belt 8 at the secondary-transfer nip. The four-colored superimposed toner image on the intermediate transfer belt 8 is secondarily transferred onto the recording sheet P entered into the secondary-transfer nip by the secondary-transfer electric field and the nip pressure applied thereto, thereby forming a full-color toner image on the recording sheet P.

A device 15 of a sheet conveyance belt 15*a* is disposed left side of the secondary-transfer nip in FIG. 2. A sheet conveyance belt 15*a* is looped around a driving roller 15*c* and a driven roller 15*b*. The device 15 of the sheet conveyance belt 15*a* rotates the sheet conveyance belt 15*a* in the counterclockwise direction in FIG. 2. The sheet conveyance belt 15*a* keeps the recording sheet P that has passed through the secondary-transfer nip on its outer surface and conveys the recording sheet P to a fixing device 16.

The fixing device 16 includes a fixing roller 16*a* and a pressure roller 16*b*. The fixing roller 16*a* includes a heat source such as a halogen lamp inside the fixing roller 16*a*. The pressure roller 16*b* is pressed and contacts the fixing roller 16*a*, thereby forming a fixing nip therebetween. A full color toner image, that is, the four-colored superimposed toner image on the recording sheet P sent to the fixing device 16 pass through the fixing nip and is fixed on the surface of the recording sheet P by heat and pressure in the fixing nip.

With reference to FIG. 1, the sheet feeder B includes a first accommodating section 31 and a second accommodating section 32 that accommodate a plurality of recording sheets P in a state of a sheet bundle The first accommodating section 31 includes a first feeding and separating unit 33 that separates the sheets P one by one and send the sheet from the first accommodating section 31 to a feeding path 35. The second accommodating section 32 includes a second feeding and separating unit 34 that separates the sheets P one by one and sends the sheet from the second accommodating section 32 to the feeding path 35. The feeding path 35 is in the sheet feeder B and transports the sheet P, which passes through the feeding and separating unit, to the sheet conveyance device C The image scanner E includes a scanner that reads an image of a document set on an exposure glass and an automatic document feeder (ADF) that automatically feeds a sheet of the document to an image reading position of the scanner. The image scanner E reads an image data of the document and sends the image data to the printing device A. The printing device A forms the image on the recording sheet P based on the image data sent from the image scanner E. Thus, the copy image of the document is produced. The printing device A also forms an image based on an image data sent from a personal computer and an image based on an image data sent form a facsimile line.

The sheet conveyance device C includes the secondary-transfer facing roller 41, the pair of registration rollers 42, an entry path 43, an ejection path 44, a turnover path 45, a retransmission path 46, a separation claw 47, and a pair of reversal rollers 48. The sheet conveyance device C receives the recording sheet P fed from the sheet feeder B into its entry path 43 and transport to the pair of registration rollers 42. The recoding sheet P is nipped in the pair of registration rollers 42, and skew of the recording sheet P is corrected. After the skew correction, the pair of registration rollers 42 starts to rotate and send the recording sheet P to the secondary-transfer nip.

After the recording sheet P is fixed a toner image and sent from the fixing device 16, the sheet conveyance device C receives the recording sheet P on the separation claw 47. Adjusting an attitude of the pivotable separation claw 47 controls a next destination of the recording sheet P. Specifically, when the recording sheet P is ejected from the image forming apparatus 100, the attitude of the separation claw 47 is set to guide the recording sheet P to the ejection path 44. The recording sheet P guided to the ejection path 44 is ejected from the image forming apparatus 100.

On the other hand, when a toner image is formed on a second surface of the recording sheet P of which a first surface has been fixed a toner image, the sheet conveyance device C set the attitude of the separation claw 47 to guide the recording sheet P to the turnover path 45. After the recording sheet P enters the turnover path 45, the switchback device D (described later) and the sheet conveyance device C work together, reverse the recording sheet P, and send the recording sheet P to the retransmission path 46. The recording sheet P sent to the retransmission path 46 is transported in the order of the entry path 43, the secondary-transfer nip, and the fixing device 16. Next, after a toner image is fixed on the second surface of the recording sheet P, the recording sheet P is sent to the ejection path 44 and ejected from the image forming apparatus 100.

The image forming apparatus 100 includes the structure that enables the sheet conveyance device C to be pulled out by sliding the sheet conveyance device C from the backside to the front side of the image forming apparatus 100 to remove the jammed recording sheet P easily when the recording sheet P is jammed in the sheet conveyance device C. In FIG. 1, the sheet conveyance device C is pulled out from the backside to the front side of the page.

Figures 3, 3A, 3B:
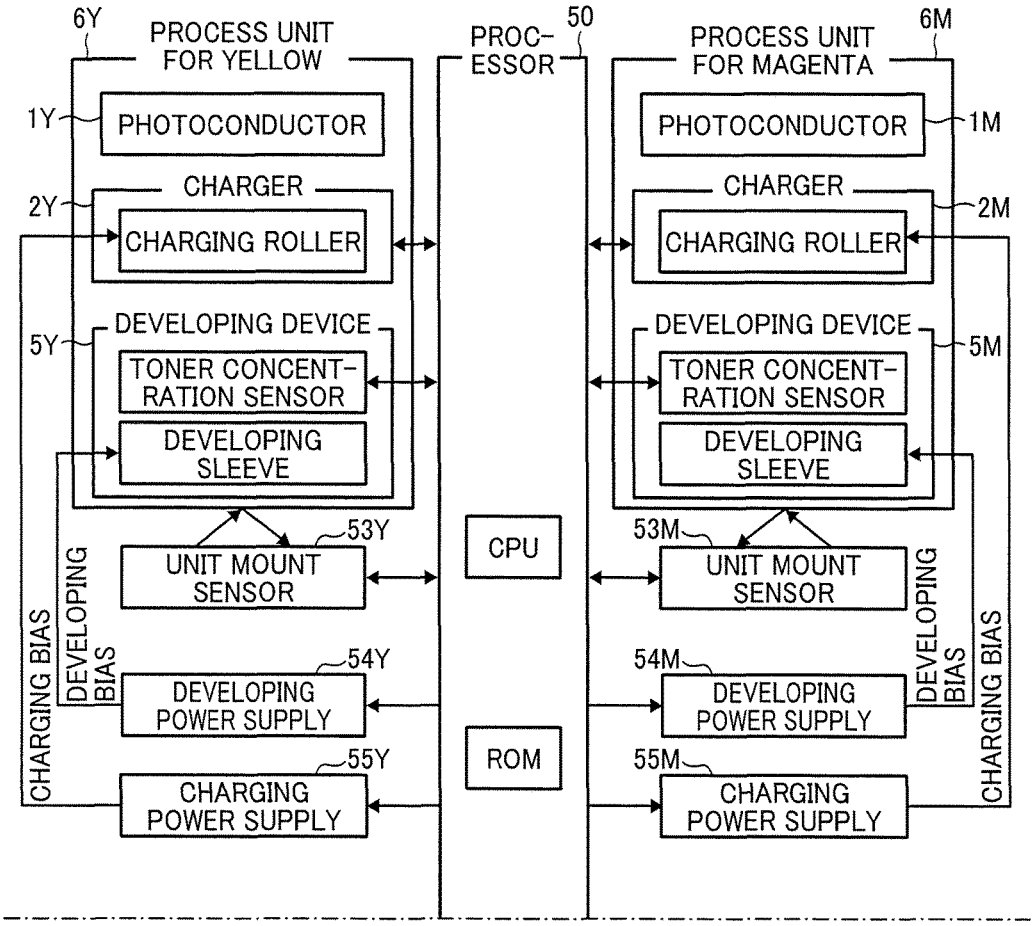
FIGS. 3A and 3B (collectively referred to as FIG. 3) are block diagrams illustrating a main part of electric circuitry of the image forming apparatus illustrated in FIG. 1.
Figure 3B:
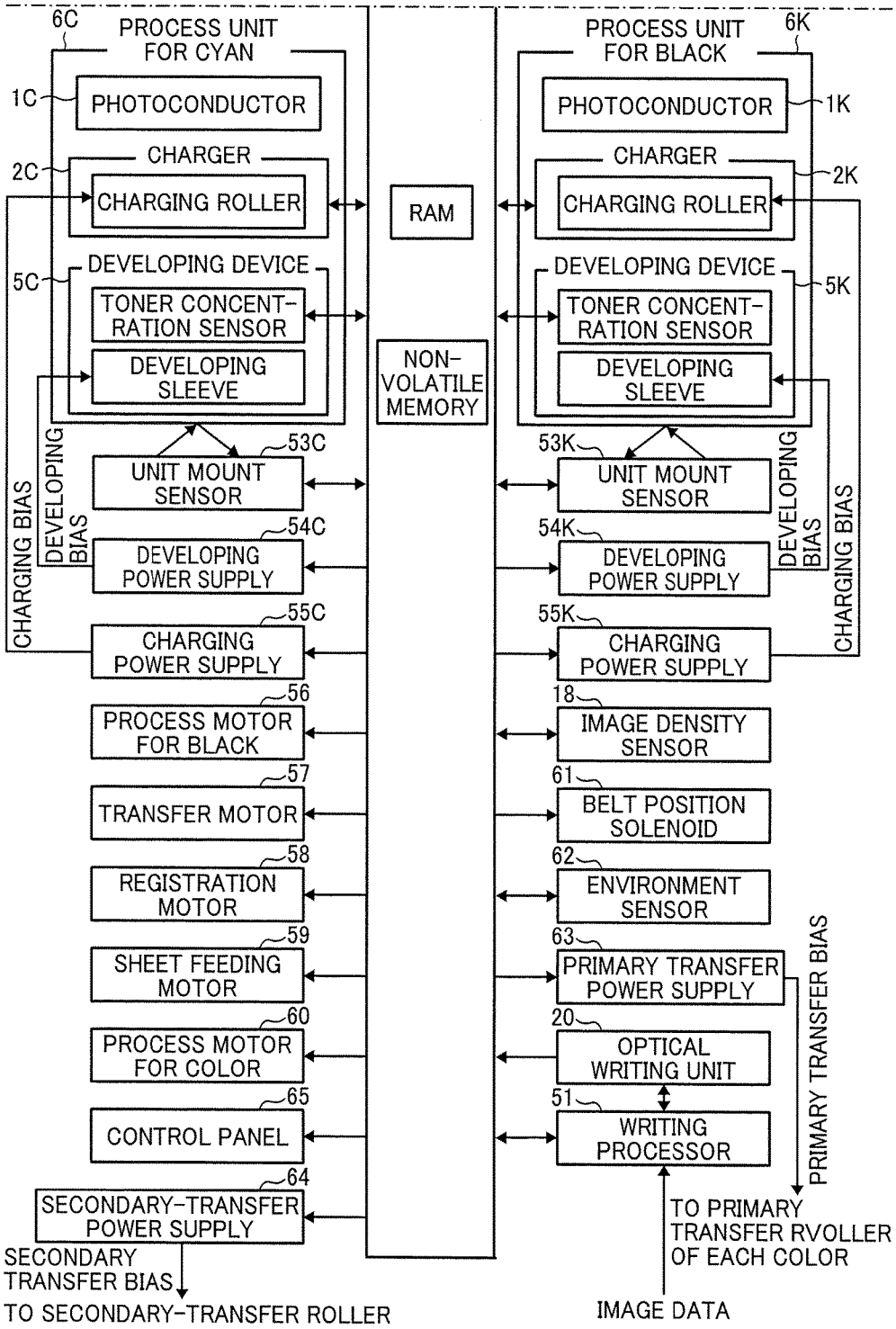

FIGS. 3A and 3B are block diagrams illustrating a main part of electric circuitry of the image forming apparatus 100 according to the present embodiment. In the configuration illustrated in FIGS. 3A and 3B, the processor 50 includes a central processing unit (CPU), a random access memory (RAM), a read only memory (ROM), a nonvolatile memory, and the like. The processor 50 is electrically connected to the toner concentration sensors of the yellow, magenta, cyan, and black developing devices 5Y, 5M, 5C, and 5K, respectively. With this structure, the processor 50 obtains the toner concentration of yellow developer, magenta developer, cyan developer, and black developer contained in the developing devices 5Y, 5M, 5C, and 5K, respectively. Based on the obtained toner concentration, the processor 50 drives toner supply devices for yellow, magenta, cyan, and black toners to supply suitable quantity yellow, magenta, cyan, and black toner to the developing devices 5Y, 5M, 5C, and 5K, respectively. With this structure, if each toner is consumed, the processor 50 keeps the target toner concentration of yellow developer, magenta developer, cyan developer, and black developer contained in the developing devices 5Y, 5M, 5C, and 5K, respectively.

Unit mount sensors 53Y, 53M, 53C, and 53K for yellow, magenta, cyan, and black, are also electrically connected to the processor 50. The unit mount sensors 53Y, 53M, 53C, and 53K respectively detect removal of the process units 6Y, 6M, 6C, and 6K from the printing device A and mounting thereof in the printing device A. With this structure, the processor 50 recognizes that the process units 6Y, 6M, 6C, and 6K have been mounted in or removed from the printing device A.

In addition, developing power supplies 54Y, 54M, 54C, and 54K for yellow, magenta, cyan, and black are electrically connected to the processor 50. The processor 50 outputs control signals to the developing power supplies 54Y, 54M, 54C, and 54K respectively and individually adjusts the value of developing bias output from each of the developing power supplies 54Y, 54M, 54C, and 54K. That is, the values of developing biases applied to developing sleeves of the developing devices 5Y, 5M, 5C, and 5K for yellow, magenta, cyan, and black can be individually adjusted.

The developing sleeve is a pipe made of non-magnetic material and including a magnet roller in its inside. The developing sleeve is rotated with developer on its surface, conveys the developer to a developing position facing the photoconductor 1, and supports developing. In the image forming apparatus 100 according to the present embodiment, the charger 2Y, 2M, 2C, and 2K uniformly charges the surface of the photoconductor 1Y, 1M, 1C, and 1K to a negative polarity. Each charged surface becomes a background portion of the image. The optical writing unit 20 irradiates an image area in the background portion with light, cause a potential decay at the image area, and forms the electrostatic latent image thereat. The developing sleeve is given a developing bias whose absolute value is between an absolute value of a background potential and an absolute value of a potential of the electrostatic latent image. Such a developing bias generates a developing potential between the developing sleeve and the electrostatic latent image. The developing potential electrostatically moves the toner from the developing sleeve to the electrostatic latent image. By contrast, a potential between the developing sleeve and the background potential electrostatically moves the toner from the background portion to the developing sleeve.

The processor 50 is electrically connected to charging power supplies 55Y, 55M, 55C, and 55K for yellow, magenta, cyan, and black. The processor 50 outputs control signals to the charging power supplies 55Y, 55M, 55C, and 55K, respectively, to adjust the value of the charging bias output from each of the charging power supplies 55Y, 55M, 55C, and 55K, individually. That is, the values of the charging biases applied to charging rollers in the chargers 2Y, 2M, 2C, and 2K for yellow, magenta, cyan, and black can be individually adjusted.

In addition, the processor 50 is electrically connected to a belt solenoid 61. The belt solenoid 61 changes a position of a side plate including bearings of the primary transfer rollers 9Y, 9M, and 9C for yellow, magenta, and cyan. Therefore, the belt solenoid 61 changes positions of the primary transfer rollers 9Y, 9M, and 9C for yellow, magenta, and cyan. The change of the positions of the primary transfer rollers results in a change in attitude of the intermediate transfer belt 8 and enables the intermediate transfer belt 8 to move from contact positions with the photoconductors 1Y, 1M, and 1C for yellow, magenta, and cyan. When a print job of a monochrome mode is performed, because only the photoconductor 1K for black is used, the intermediate transfer belt 8 is disengaged from the photoconductors 1Y, 1M, and 1C for yellow, magenta, and cyan. When a print job of a full color mode is performed, the intermediate transfer belt 8 is moved to all the photoconductors 1Y, 1M, 1C, and 1K for yellow, magenta, cyan, and black and contacts all the photoconductors 1Y, 1M, 1C, and 1K.

The processor 50 is electrically connected to a process motor for black 56 and a process motor for color 60. The process motor for black 56 is a driving source to drive various parts of the process unit 6K for black. The process motor for color 60 is a driving source to drive various parts of the process units 6Y, 6M, and 6C for yellow, magenta, and cyan. When the print job of the monochrome mode is performed, the processor 50 drives only the process motor for black 56 of the two process motors. By contrast, when the print job of the full color mode is performed, the processor 50 drives the two process motors.

In addition, the processor 50 is electrically connected to a writing processor 51, a transfer motor 57, a registration motor 58, a sheet feeding motor 59, an environment sensor 62, the primary transfer power supply 63, the secondary-transfer power supply 64, the image density sensor 18, the optical writing unit 20, and the like.

The writing processor 51 controls the optical writing unit 20 based on the image data sent from an external scanner or a personal computer to perform an optical scan for each of the photoconductors 1Y, 1M, 1C, and 1K. The writing processor 51 also sends the receiving image data to the processor 50.

The environment sensor 62 detects the temperature and the humidity inside the image forming apparatus 100. The transfer motor 57 is a driving source for the driving roller 11 and the intermediate transfer belt 8. The registration motor 58 is a driving source for the pair of registration rollers 42. The sheet feeding motor 59 is a driving source for the sheet feeder B and the sheet conveyance. The primary transfer power supply 63 outputs the primary transfer biases applied to the primary transfer rollers 9Y, 9M, 9C, and 9K for yellow, magenta, cyan, and black, respectively. The secondary-transfer power supply 64 outputs the secondary-transfer bias applied to the secondary-transfer roller 12.

The processor 50 individually outputs control signals for yellow, magenta, cyan, and black to the primary transfer power supply 63 to adjust each value of the primary transfer bias for yellow, magenta, cyan, and black that is output from the primary transfer power supply 63. The processor 50 outputs a control signal to the secondary-transfer power supply 64 to adjust the value of the secondary-transfer bias that is output from the secondary-transfer power supply 64.

The processor 50 is electrically connected to a control panel 65 that functions as an information notification device and an information input device. The control panel 65 includes a display including a touch panel and an input device including a numeric keypad or the like. Various information is displayed on the touch panel to notify the information to a user. The input device enables to receive information input from the numeric keypad or the like by a user operation.

Figure 4:
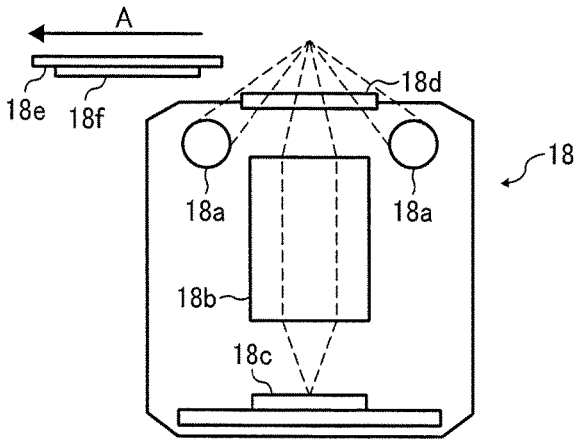
FIG. 4 is a schematic view of an image density sensor incorporated in the printing device illustrated in FIG. 2.

FIG. 4 is a schematic view of an image density sensor 18. In FIG. 4, the image density sensor 18 includes, for example, light sources 18*a*, a lens array 18*b*, an imaging element array 18*c*, a detection window 18*d* made of transparent glass, a shutter 18*e*, and a white reference board 18*f*.

The shutter 18*e* is movable back and forth, driven by an actuator, along the belt rotating direction indicated by arrow A. A reciprocating movement of the shutter 18*e* opens and closes the detection window 18*d*. In FIG. 4, the shutter 18*e* is moved from just above the detection window 18*d*, to open the detection window 18*d*.

The white reference board 18*f* may be, for example, a LUMIRROR E20 (produced by Toray Industries, Inc.), which is a white film. The white reference board 18*f* is secured to a back surface of the shutter 18*e* by, for example, a double-sided adhesive tape, thereby moving back and forth along the belt rotating direction with the shutter 18*e*.

Each of the light sources 18*a* may include a light guide having an end provided with a light emitting device. Alternatively, light-emitting diode (LED) arrays may be used as the light sources 18*a*. The light sources 18*a* emit white light. Alternatively, however, light sources that individually emit red light, green light and blue light may be used as the light sources 18*a*.

The lens array 18*b* includes, for example, a SELFOC® lens. The imaging element array 18*c* includes an array of image sensors. The image sensors individually receive red light, green light and blue light focused by the lens array 18*b* and output signals corresponding to the red light, green light and blue light. For example, a complementary metal oxide semiconductor (CMOS) sensor or a charge-coupled device (CCD) sensor is used as the imaging element array 18*c*.

The image density sensor 18 may be, for example, a contact image sensor (CIS).

Figure 5:
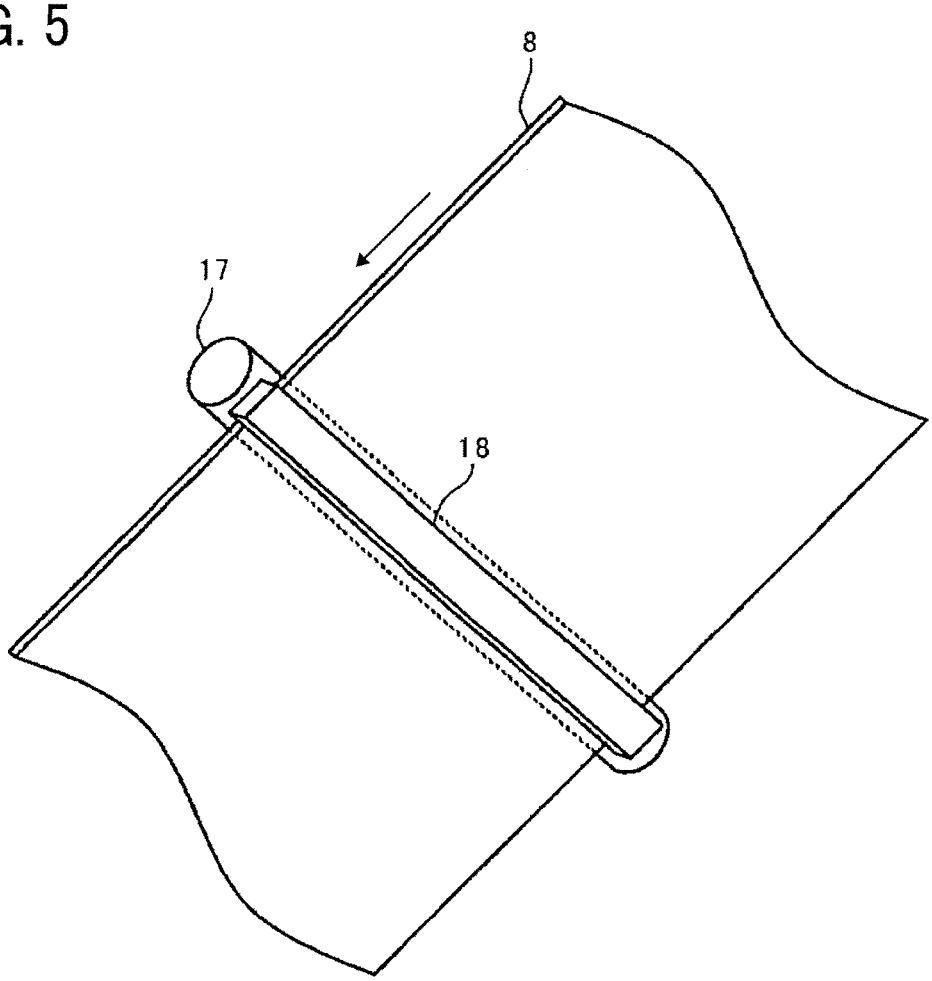
FIG. 5 is a perspective view of the image density sensor together with part of an intermediate transfer belt as seen from below.
Figure 6:
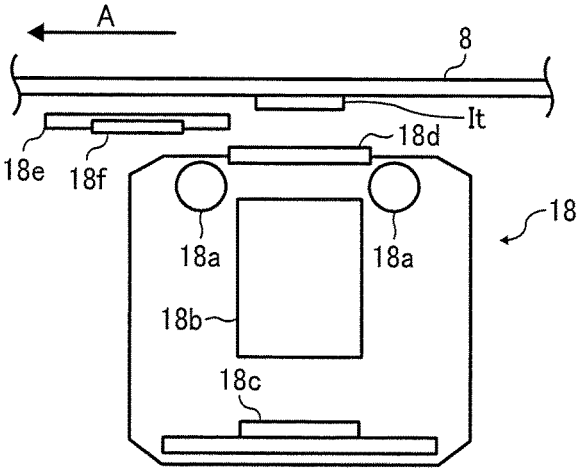
FIG. 6 is a schematic view of the image density sensor with a shutter thereof open.
Figure 7:
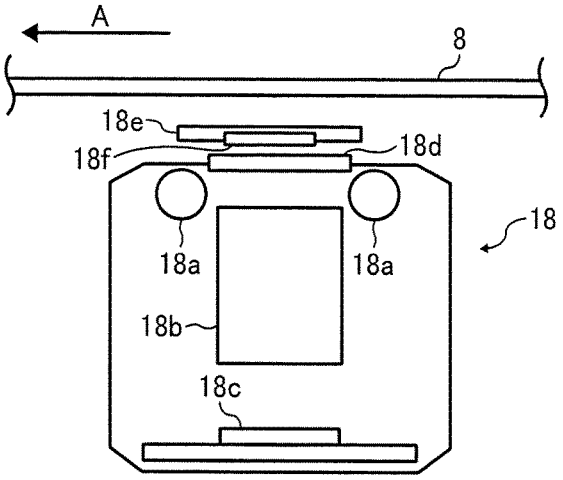
FIG. 7 is a schematic view of the image density sensor with the shutter thereof closed.

As shown in FIG. 5, the image density sensor 18 is disposed to face the outer surface (loop outer surface) of the intermediate transfer belt 8 across a predetermined gap. A longitudinal direction of the image density sensor 18 coincides with a width direction of the intermediate transfer belt 8. The image density sensor 18 is longer than a width of the intermediate transfer belt 8. With such a configuration, the image density sensor 18 detects an image density of each pixel of an entire area in a longitudinal direction of a test toner image, described later, that is formed on the outer surface of the intermediate transfer belt 8. It is to be noted that, even if a length of the image density sensor 18 in the longitudinal direction is not longer than the width of the intermediate transfer belt 8, when the length of the image density sensor 18 in the longitudinal direction is substantially equal to or longer than a length of an effective image area, the image density sensor 18 can detect the image density of each pixel of the entire area in the longitudinal direction of the test toner image In the image density sensor 18, a direction in which the plurality of imaging elements is arranged side by side is the same as the longitudinal direction of the image density sensor 18. As illustrated in FIG. 6, the shutter 18*e* is opened when the image density sensor 18 detects the image density of the test toner image It formed on the intermediate transfer belt 8. When the image density sensor 18 does not detect the image density, as illustrated in FIG. 7, the processor 50 controls the image density sensor 18, moves the shutter 18*e* to above the detection window 18*d*, and closes the detection window 18*d*. Such a configuration prevents contamination of the detection window 18*d*. When the shutter 18*e* closes the detection window 18*d*, the image density sensor 18 does not detect the test toner image It on the intermediate transfer belt 8, but instead detects the white reference board 18*f* secured to the back surface of the shutter 18*e*.

The image density sensor 18 is different from a simple reflective photosensor in that the image density sensor 18 images the test toner image with a high resolution of from 300 to 1200 dots per inch (dpi). Unlike a simple reflective photosensor that detects the image density of, for example, a patch several centimeters square, the image density sensor 18 can detect the image density of a smaller patch, for example, a patch several millimeters square. Accordingly, in the present embodiment, the test toner image is downsized by including smaller patches than typical patches subject to detection.

At initial operation after factory shipment, the processor 50 performs a calibration process for shading correction data. In the calibration process for shading correction data, shading correction data is established according to pixel data of image data obtained when the image density sensor 18 detects the white reference board 18*f*. Specifically, if the white reference board 18*f* and the detection window 18*d* is perfectly clean, each pixel of the image data obtained by detecting the white reference board 18*f* is white theoretically. For example, tones of red (R), green (G) and blue (B) of each pixel are expressed in natural number of eight bits with 201 gradation scales from 0 to 200, handling the gradation scales from 200 to 255 as a scale 200. In this case, if the white reference board 18*f* and the detection window 18*d* are perfectly clean, each pixel of the image data obtained when the image density sensor 18 detects the white reference board 18*f* has a value of R=200, G=200 and B=200. However, in actuality, the pixels of the image data slightly differ in value due to variation in sensitivity of imaging elements of an image line sensor or variation in amount of light emitted from light sources. Therefore, unevenness in density might be erroneously detected. In order to prevent such erroneous detection of unevenness in density, correction data for recognizing all the pixels as white is established as the shading correction data.

In the image forming apparatus 100 according to the present embodiment, an anomaly of the image forming apparatus 100 may cause a streaked image. In the streaked image, its image density is extremely lower or higher than an original image density. A form of the streaked image is a streak extending in a sub-scanning direction of the image. The sub-scanning direction is a direction along a direction of movement of the photoconductor 1Y, 1M, 1C, and 1K, the intermediate transfer belt 8, or the image in the image forming apparatus 100. By contrast, a main-scanning direction is a direction along a rotational axial direction of the photoconductor 1Y, 1M, 1C, and 1K, and perpendicular to the sub-scanning direction.

Figure 8:
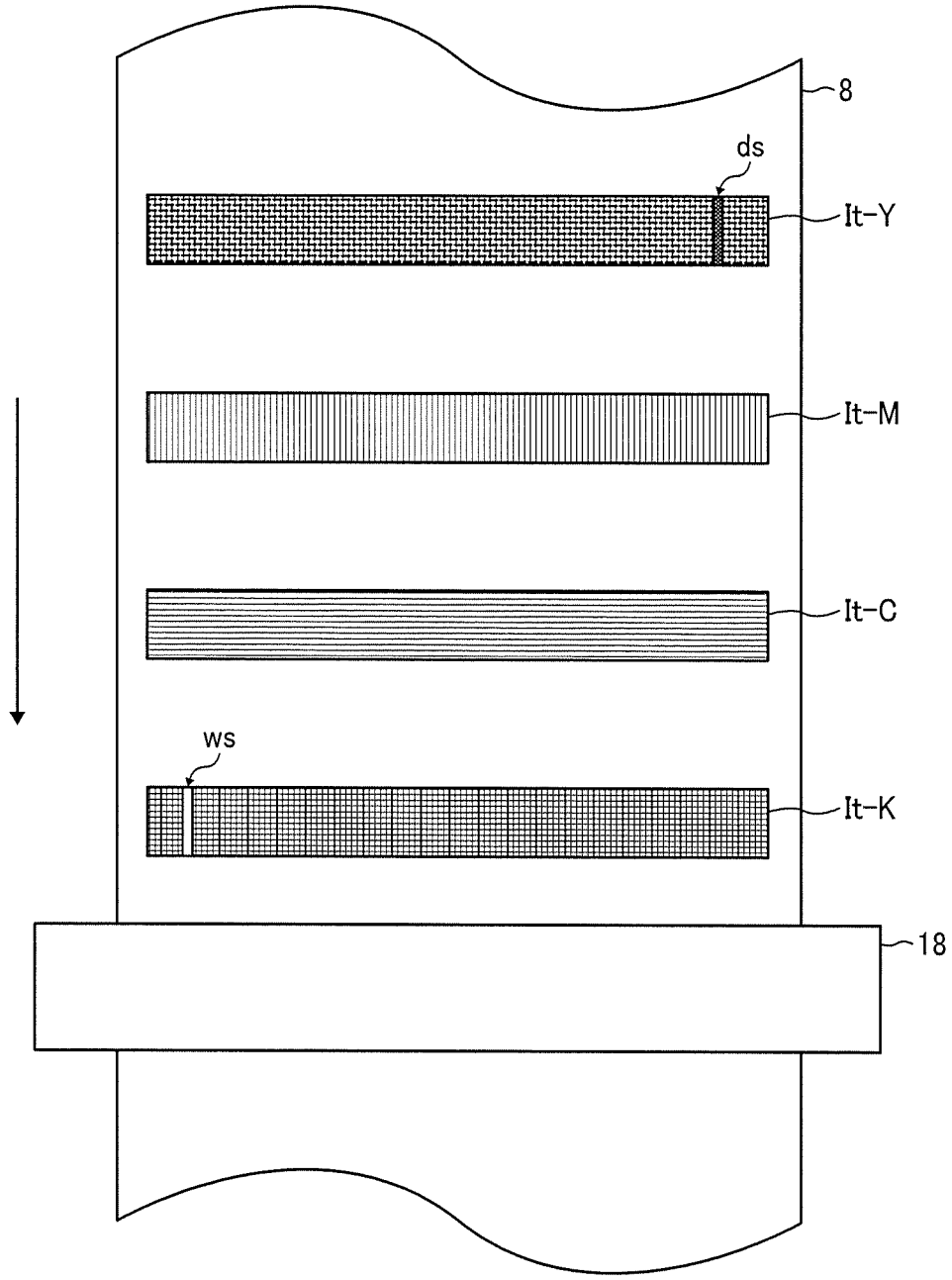
FIG. 8 is a schematic view illustrating a black test toner image It-K, a cyan test toner image It-C, a magenta toner test image It-M, and an yellow test toner image It-Y, which are formed on the outer surface of the intermediate transfer belt, with the intermediate transfer belt and the image density sensor.

The processor 50 regularly performs a process that determines whether the streaked image exists in the test toner image. When the streaked image exists in it, the processor 50 informs a user that the streaked image occurs. FIG. 8 is a schematic view illustrating a black test toner image It-K, a cyan test toner image It-C, a magenta toner test image It-M, and an yellow test toner image It-Y, which are formed on the outer surface of the intermediate transfer belt 8, with the intermediate transfer belt 8 and the image density sensor 18 in the process described above.

As illustrated in FIG. 8, the test toner image of each color (It-K, It-C, It-M, and It-Y) is formed as a square pattern extending in the width direction of the intermediate transfer belt 8. The length of the test toner image in the width direction is shorter than the width of the intermediate transfer belt 8 and substantially same as a length of an effective image area in the width direction.

In FIG. 8, a white streak ws as the streaked image occurs in the black test toner image It-K among the test toner images. The white streak ws is the streaked image formed with an image density that is extremely lower than the original image density. The white streak ws illustrated in FIG. 8 extending in the sub-scanning direction (a direction of an arrow in FIG. 8) may be caused by a foreign material adhesion to a dustproof glass that is a light emitting part of the optical writing unit 20 or a foreign material contamination in the developer in the developing device (for example, 5Y).

Additionally, in FIG. 8, a dark streak ds as the streaked image occurs in the yellow test toner image It-Y among the test toner images including each of the four colors. The dark streak ds is the streaked image formed with an image density that is extremely higher than the original image density. The dark streak ds, as illustrated in FIG. 8, extending in the sub-scanning direction may be caused by a foreign material adhesion to the charging roller in the charger (for example, 2Y).

After the processor 50 starts the process described above, the processor 50 forms the test toner images including each of the four colors. Subsequently, the processor 50 controls the image density sensor 18 to image each of the test toner images and acquires image data of pixels of the test toner images to obtain an image density of each of the pixels. Based on the obtained image densities of pixels, the processor 50 determines whether the white streak or the dark streak occurs in each of the test toner images. When the white streak or the dark streak occurs, the processor 50 notifies the user the occurrence of the streak. Specifically, the control panel 65 such as the touch panel displays a message such as "A white streak occurs in the black image. Please request repair to the maintenance organization". The user is notified of the occurrence of the streaked image and the color in which the streaked image occurs.

In the above system, when the streaked image occurs, the processor 50 immediately detects the occurrence of the streaked image and notifies the occurrence of the streaked image to the user to recommend the user the quick request of repair. With this feature, downtime from the occurrence of the streaked image to end of the repair, which needs to discover the cause of the streaked image, is shortened.

However, a streak that is not due to a device failure may occur. The streak is a streaky image density deviation that can be eliminated by adjusting an image forming condition of the image forming device. Misdetection of the streaky image density deviation as the streaked image leads the user to request an unnecessary repair order. For example, uneven electrical resistance of the charging roller in its rotational axis direction causes a background potential unevenness in a rotational axis direction of the photoconductor 1. A background potential at a portion of the photoconductor 1 in a rotational axis direction of the photoconductor 1 becomes higher than the background potential in another portion of the photoconductor 1. An image density at the portion of the higher background potential becomes lower than the one in another portion. This results in the white streak as the streaky image density deviation. It is possible to eliminate such the white streak, for example, by setting an optical writing power (a laser power) during an optical scan as the image forming condition at the portion of the higher background potential greater than the one in another portion. In spite of the possibility, misdetection as the white streak ws of the streaked image and its notification leads the user to request the unnecessary repair order.

In the image forming apparatus 100, a set consisting of the optical writing unit 20 and the process units 6Y, 6M, 6C, and 6K corresponding to each color functions as the image forming device to form the toner image.

The processor 50 controls the image density sensor 18 to image each of a second test toner image It2 formed on the intermediate transfer belt 8 by each of colors, yellow, magenta, cyan, and black and acquires image data of the second test tone image It2. Based on the image data, the processor determines whether a streaked image exists in the second test toner image It2. However, prior to the above determination, the processor 50 controls the image density sensor 18 to image a first test toner image It1 formed on the intermediate transfer belt 8 and acquires image data of the first test toner image It1. Based on the image data, the processor determines whether the streaky image density deviation extending in the sub-scanning direction exists in the first test toner image It1. In the determination based on the first test toner image, when the processor 50 determines the image density deviation exists, the processor 50 adjusts the image forming condition to eliminate the image density deviation. Specifically, the processor 50 adjusts the optical writing power during the optical scan in the rotational axial direction of the photoconductor 1 (that is, the main scanning direction) corresponding to the portion of the streaky image density deviation greater or smaller than the optical writing power corresponding to another portion that does not correspond to the streaky image density deviation. More specifically, when the streaky image density deviation is the streak at which the image density becomes lower than another portion, the processor 50 adjusts the optical writing power corresponding to the streak portion greater than the optical writing power corresponding to another portion. Thus, only the image density at the streak portion becomes higher. On the other hand, when the streaky image density deviation is the streak at which the image density becomes higher than another portion, the processor 50 adjusts the optical writing power corresponding to the streak portion smaller than the optical writing power corresponding to another portion. Thus, only the image density at the streak portion becomes lower.

Figure 9:
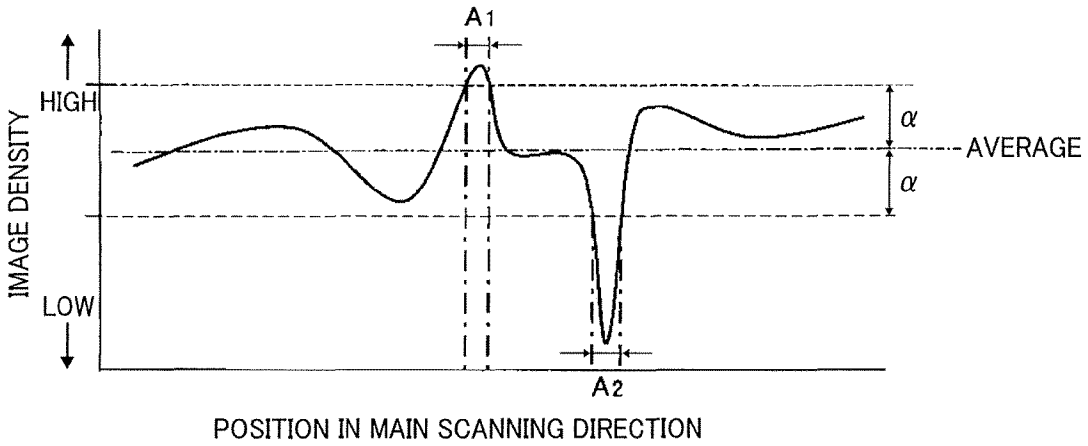
FIG. 9 is a graph illustrating a relation between a position in a main scanning direction and an image density of a first test toner image It1.

FIG. 9 is a graph illustrating a relation between a position in the main scanning direction and an image density of a first test toner image It1. The processor 50 obtains the image density of the first test toner image It1 at each pixel (each position) in the main scanning direction based on the image data obtained by the image density sensor 18 that images the first test toner image It1, and calculates an average image density of obtained image densities. Furtherly, the processor 50 determines whether a difference between the average image density and the image density at each pixel is higher than a predetermined threshold value $\alpha$. This predetermined threshold value $\alpha$ is determined by an image density difference of a standard image density chart, experiments that determine a range where ordinary users cannot recognize streaky image density deviation in the first test toner image, or something like that.

In FIG. 9, an image density at a pixel existing in a portion A1 of the first test toner image in the main scanning direction is higher than the average image density. Additionally, the difference between the average image density and the image density at the pixel existing in the portion A1 is greater than the threshold value $\alpha$. This means the occurrence of a dark streak at the portion A1. The dark streak may be the streaky image density deviation that can be eliminated by adjusting the image forming condition or the streaked image that is due to device malfunction. If the dark streak is the streaked image, the repair is needed, but, if the dark streak is the streaky image density deviation, the dark streak can be eliminated by adjusting the image forming condition without requesting the repair.

Furtherly, in FIG. 9, an image density at a pixel existing in a portion A2 of the first test toner image in the main scanning direction is lower than the average image density. Additionally, the difference between the average image density and the image density at the pixel existing in the portion A2 is greater than the threshold value α. This means the occurrence of the white streak at the portion A2. The white streak may be the streaky image density deviation that can be eliminated by adjusting the image forming condition or the streaked image that is due to device malfunction. If the white streak is the streaked image, the repair is needed, but, if the white streak is the streaky image density deviation, the white streak can be eliminated by adjusting the image forming condition without requesting the repair. The image forming condition for the adjustment may be the optical writing power during the optical scan as described above.

When there is an abnormal pixel, that is, the difference between the average image density and the image density at the abnormal pixel is greater than the threshold value α, the processor 50 adjusts the optical writing power of a pixel on the photoconductor surface corresponding to the abnormal pixel in the main scanning direction so that the image density of the abnormal pixel is close to the average image density. For example, in FIG. 9, the processor 50 adjusts the optical writing power during the optical scan of each pixel on the photoconductor surface corresponding to each pixel existing in the portion A1 of the first test toner image It1 smaller than the optical writing power before this adjustment and decreases the image density of each pixel in the portion A1. Additionally, the processor 50 adjusts the optical writing power during the optical scan of each pixel on the photoconductor surface corresponding to each pixel existing in the portion A2 of the first test toner image It1 greater than the optical writing power before this adjustment and increases the image density of each pixel in the portion A2.

If the streak in the first test toner image It1 is the streaky image density deviation that can be eliminated by adjusting the optical writing power, the above-described adjustment of the optical writing power should eliminate the streak in images formed after the adjustment.

Therefore, the processor 50 forms the second test toner image It2 after adjusting the optical writing power based on the image density of each pixel in the first test toner image It1 for each of colors, yellow, magenta, cyan, and black. Subsequently, the processor 50 controls the image density sensor 18 to image the second test toner image It2 and acquires the image data of the second test toner image 1*t*2. Based on the image data, the processor 50 determines whether the streaked image exists in the second test toner image It2.

Figure 10:
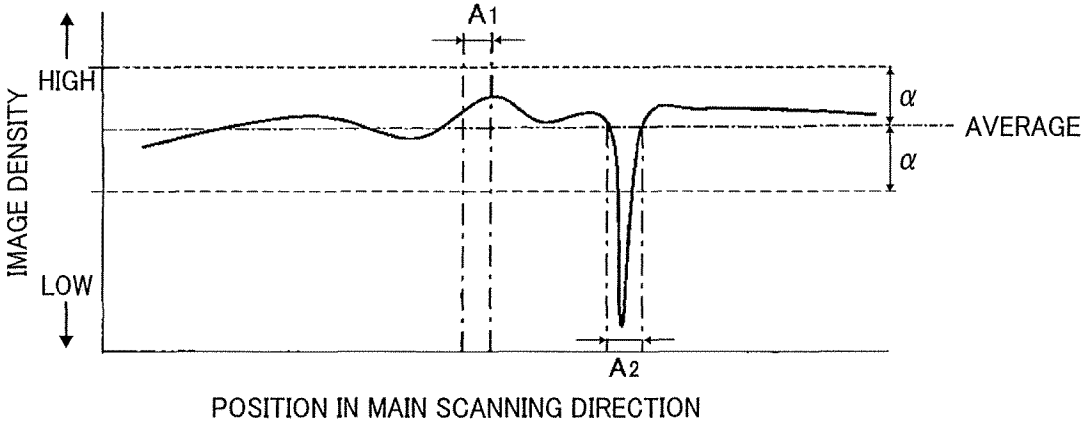
FIG. 10 is a graph illustrating a relation between a position in a main scanning direction and image densities of a second test toner image It2.

FIG. 10 is a graph illustrating a relation between the position in the main scanning direction and the image density of the second test toner image 112. The processor 50 obtains the image density of the second test toner image It2 at each pixel in the main scanning direction based on the image data obtained by the image density sensor 18 that images the second test toner image It2, and calculates an average image density of obtained image densities. Furtherly, the processor 50 determines whether a difference between the average image density and the image density at each pixel is higher than the predetermined threshold value α. The threshold value α is the same value as the threshold value α in FIG. 9.

In FIG. 10, each of image densities at all pixels existing in the portion A1 of the second test toner image It2 in the main scanning direction is higher than the average image density. However, the differences between the average image density and each of image densities at all pixels in the portion A1 are smaller than the threshold value α. This means the dark streak at the portion A1 in the first test toner image It1 changes and does not exist at the portion A1 in the second test toner image It2. That is, the dark streak at the portion A1 in the first test toner image It1 is not the streaked image that is due to device malfunction, and is the streaky image density deviation that can be eliminated by adjusting the optical writing power.

On the other hand, in FIG. 10, an image density of each pixel existing in the portion A2 of the second test toner image It2 in the main scanning direction is lower than the average image density. Furtherly, the difference between the average image density and the image density of some pixels, not all pixels, existing in the portion A2 is greater than the threshold value α. The visible white streak is still left after adjusting the optical writing power. This means the white streak at the portion A2 is not the type of streaky image density deviation that is eliminated by adjusting the optical writing power, and is the streaked image that is due to device malfunction.

When the difference between the average image density and the image density of the streak in the second test toner image It2 is greater than the threshold value α, the processor 50 determines the streak is the streaked image that is due to device malfunction. Specifically, when the image density of the streak is lower than the average of the image density, the processor 50 determines the streak is the white streak ws. Similarly, when the image density of the streak is higher than the average of the image density, the processor 50 determines the streak is the dark streak ds. In FIG. 10, the streak at the portion A2 is determined as the white streak ws.

In the above described example, the processor 50 determines the occurrence of the streak when the difference between the average image density and the image density of the streak in the first test toner image It1 and the second test toner image It2 is greater than the threshold value α, but alternatively the processor 50 may determine as follows. That is, the processor 50 may determine the occurrence of the streak when the difference between the average and the image density of the streak in the first test toner image It1 and the second test toner image It2 is equal to or greater than the threshold value α.

Since the image density of a solid toner image is very high, even if the pixel at which a toner adhesion amount in a unit area is more than a toner adhesion amount in a unit area around the pixel occurs in the solid toner image, increase of the image density that is due to the pixel is not noticeable. This means it is difficult to detect an abnormal high image density in the solid toner image. By contrast, when the pixel in which the toner adhesion amount in a unit area is less than the toner adhesion amount in a unit area around the pixel occurs, decrease of the image density that is due to the pixel is noticeable. This means an abnormal low image density in the solid toner image becomes noticeable. Therefore, it is possible to detect the white streak ws in the solid toner image accurately.

On the other hand, because an image density of a halftone toner image is much lower than a saturated image density, when the pixel at which a toner adhesion amount in a unit area is more than a toner adhesion amount around the pixel occurs in the halftone toner image, increase of the image density that is due to the pixel is noticeable. This means an abnormal high image density in the halftone toner image becomes noticeable. That is, it is possible to detect the dark streak ds in the halftone toner image accurately.

Therefore, the processor 50 forms the following two test toner images as the first test toner image It1 for each of colors, yellow, magenta, cyan, and black. One is a first solid test toner image bIt1 in which toner adheres to all pixels in an image area. Another is a first halftone test toner image hIt1 in which a halftone is expressed by an area coverage modulation. In the area coverage modulation, toner does not adhere to a part of pixels in the image area. That is, the processor 50 forms the first solid test toner image bIi1 as the first test toner image with high image density and the first halftone test toner image hIt1 as the first test toner image with low image density for each of colors, yellow, magenta, cyan, and black.

The processor 50 controls the image density sensor 18 to image each pixel of the first solid test toner image bIt1 and acquires the image data of the first solid test toner image bIt1. Based on the image data, the processor 50 determines whether an image density of each pixel is lower than an average image density of the first solid test toner image bIt1. This average image density may be stored as a predetermined condition in the memory. When there is a pixel at which the image density is lower than the average image density, the processor 50 determines whether a difference between the average image density and the image density at the pixel is greater than the predetermined threshold value α. If the difference between the average image density and the image density at the pixel is greater than the predetermined threshold value α, the processor 50 determines the image density at the pixel is insufficient. It is to be noted that this image data is not used for a determination about abnormal high image density. A system described above can detect an insufficient image density more accurately than a system in which a processor determines the insufficient image density based on an image density of each pixel in the first halftone test toner image hIt1.

Additionally, the processor 50 controls the image density sensor 18 to image each pixel of the first halftone test toner image hIt1 and acquires the image data of the first halftone test toner image hIt1. Based on the image data, the processor 50 determines whether an image density of each pixel is higher than an average image density of the first halftone test toner image hIt1. This average image density may be stored as a predetermined condition in the memory. When there is a pixel at which the image density is higher than the average image density, the processor 50 determines whether a difference between the average image density and the image density at the pixel is greater than the predetermined threshold value α. If the difference between the average image density and the image density at the pixel is greater than the predetermined threshold value α, the processor determines the image density at the pixel is excessive. It is to be noted that this image data is not used for a determination about abnormal low image density. A system described above can detect an excessive image density more accurately than a system in which a processor determines the excessive image density based on an image density of each pixel in the first solid test toner image bIt1.

Subsequently, the processor 50 forms the following two test toner image as the second test toner image It2 for each of colors, yellow, magenta, cyan, and black. One is a second solid test toner image bIt2 whose image density is same as the first solid test toner image bIt1. Another is a second halftone test toner image hIt2 whose image density is same as the first halftone test toner image hIt1. That is, the processor 50 forms the second solid test toner image bIt2 as the second test toner image with high image density and the second halftone test toner image hIt2 as the second test toner image with low image density for each of colors, yellow, magenta, cyan, and black.

The processor 50 controls the image density sensor 18 to image each pixel of the second solid test toner image bIt2 and acquires the image data of the second solid test toner image bIt2. Based on the image data, the processor 50 determines whether an image density of each pixel is lower than an average image density of the second solid test toner image bIt2. When there is a pixel at which the image density is lower than the average image density, the processor 50 determines whether a difference between the average image density and the image density at the pixel is greater than the predetermined threshold value α. If the difference between the average image density and the image density at the pixel is greater than the predetermined threshold value α, the processor determines the pixel is an abnormally low image density, that is, the white streak occurs. It is to be noted that this image data is not used for a determination about abnormal high image density. A system described above can detect the white streak more accurately than a system in which a processor determines the abnormally low image density based on an image density of each pixel in the second halftone test toner image hIt2.

Additionally, the processor 50 controls the image density sensor 18 to image each pixel of the second halftone test toner image hIt2 and acquires the image data of the second halftone test toner image hIt2. Based on the image data, the processor 50 determines whether an image density of each pixel is higher than an average image density of the second halftone test toner image hIt2. When there is a pixel at which the image density is higher than the average image density, the processor 50 determines whether a difference between the average image density and the image density at the pixel is greater than the predetermined threshold value α. If the difference between the average image density and the image density at the pixel is greater than the predetermined threshold value α, the processor determines the pixel is an abnormally high image density, that is, the dark streak occurs. It is to be noted that this image data is not used for a determination about abnormal low image density. A system described above can detect the dark streak more accurately than a system in which a processor determines the dark streak based on an image density of each pixel in the second solid test toner image bIt2.

Figure 11A:
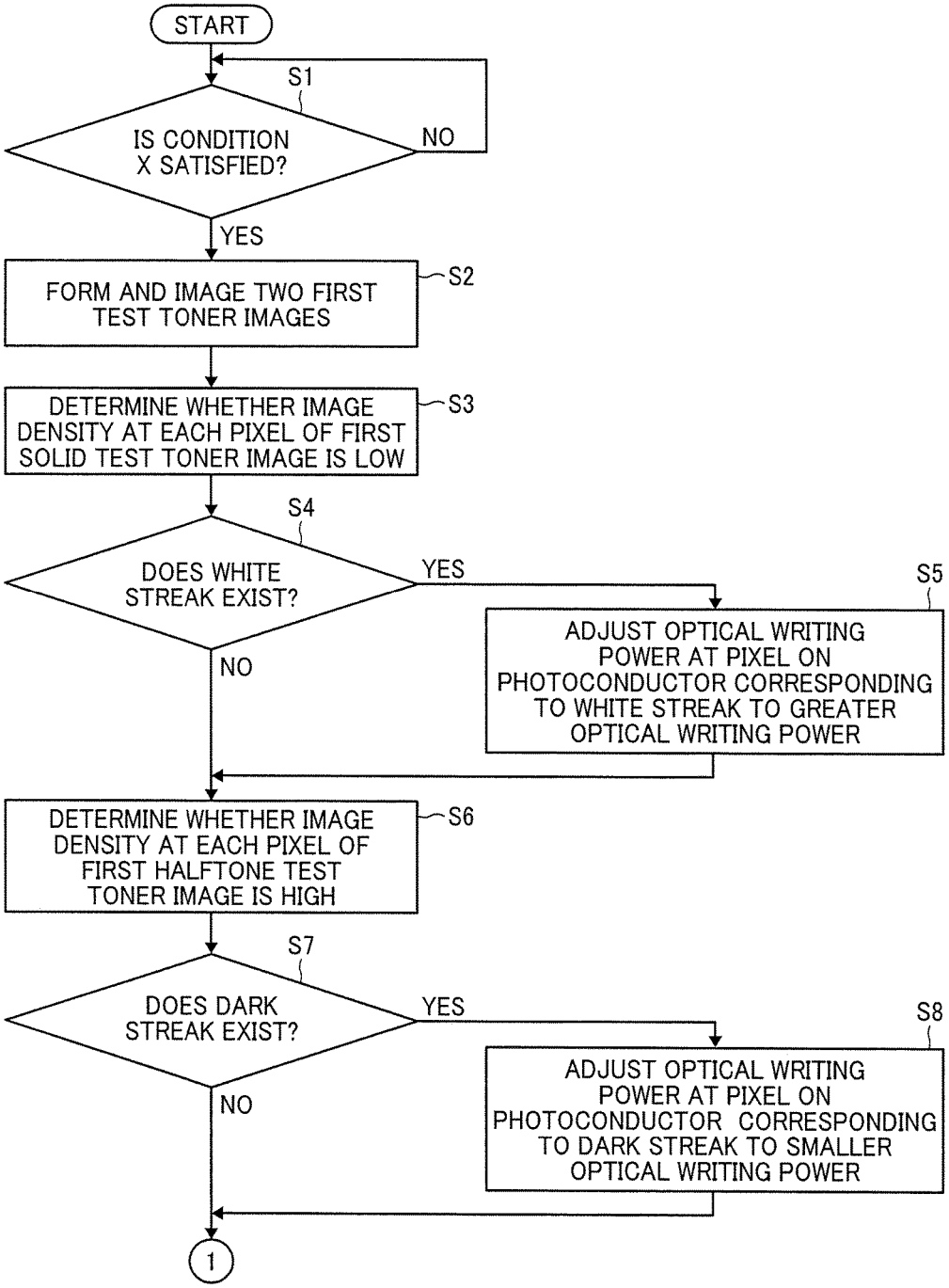
FIGS. 11A and 11B (collectively referred to as FIG. 11) are flowcharts illustrating steps in a process of a regular routine control performed by a processor of the image forming apparatus.
Figure 11B:
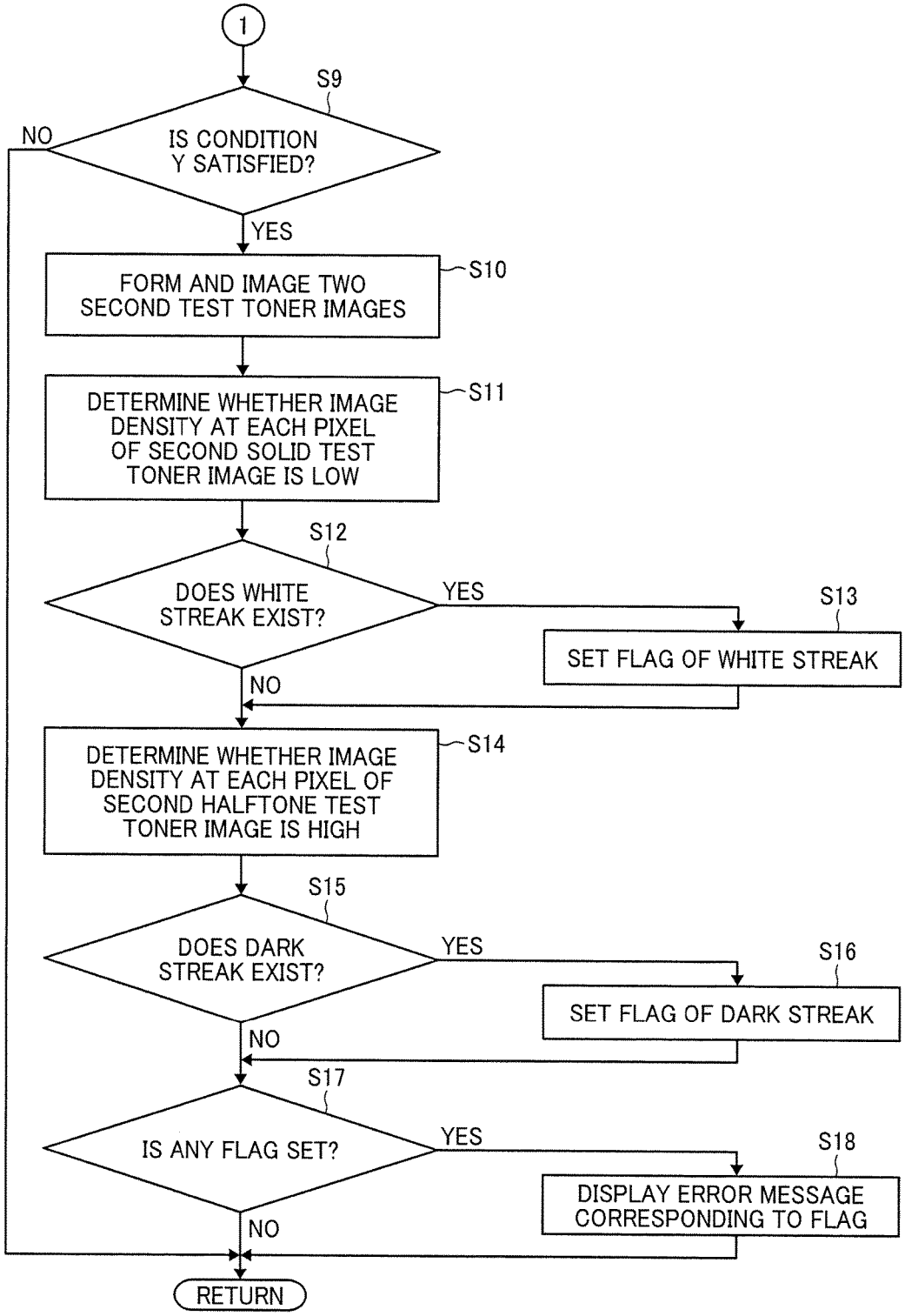

FIG. 11 is a flowchart illustrating steps in a process of a regular routine control performed by the processor 50. Steps from step S1 to step S8 in the regular routine control are steps in a process to adjust the optical writing power during the scan at the pixel on the photoconductor 1 at which the image density deviation occurs to make the image density at the pixel close to a target image density. Because various factors affect an image density variation at each pixel with time, this process is preferably performed at a regular timing corresponding to a timing of the image density variation.

Steps from step S10 in the regular routine control illustrated in FIG. 11 are steps in a process to determine the occurrence of the white streak ws and the dark streak ds that are due to device malfunction and display an error if needed. Because the white streak ws and the dark streak ds that are due to device malfunction occur less frequently than the image density variation with time, steps regarding the streak (steps from step S10) are preferably performed less frequently than steps regarding the adjustment of the image density. Performing all steps from step S1 to step S18 at the same frequency means performing steps from step S10 unnecessarily and frequently, which means unnecessary downtime of the image forming apparatus 100.

Therefore, this image forming apparatus 100 sets an implementation trigger of the steps from step S1 to step S8 to a condition X and an implementation trigger of the steps from S10 to the condition X and a condition Y. The condition X is either of the followings (1) to (5). The condition X is satisfied when either of the followings (1) to (5) is satisfied. (1) An accumulated number of printed sheets after step S7 is performed has reached a predetermined number. (2) An elapsed time since step S7 is performed has reached a predetermined time. (3) A change in absolute humidity since step S7 is performed becomes greater than a predetermined value. (4) After a power source is switched OFF and a predetermined time passes, the power source is switched ON. (5) A standby time that waits for the next print command has reached a predetermined time.

The condition Y is satisfied when a number of pixels on the photoconductor 1 that are adjusted optical writing powers in steps from step S1 to step S8 is equal to or greater than a predetermined value.

The processor 50 that starts the regular routine control firstly waits until the condition X is satisfied (NO in step S1). When the condition X is satisfied (YES in step S1), the first solid test toner image bIt1 and the first halftone test toner image hIt1 are formed and imaged in step S2. Subsequently, the processor 50 determines whether the image density at each pixel of the first solid test toner image bIt1 is low (the image density at each pixel is lower than the average image density, and a difference between the average image density and the image density at each pixel is greater than the predetermined threshold value $\alpha$) in step S3. Based on the determined result, the processor 50 determines whether the white streak caused by the low image density at each pixel exists in the first solid test toner image bIt1 in step S4. If the white streak does not exist (NO in step S4), the processor 50 proceeds to step S6 described later. If the streak exists (YES in step S4), the processor 50 adjusts the optical writing power during the optical scan at the pixel on the photoconductor 1 corresponding to the streak to a greater optical writing power in step S5 and proceeds to step S6 described later. In step S4, the processor 50 determines the white streak exists when the number of pixels in which the image density is lower than the average image density and the difference between the average image density and the image density of the pixel is greater than the threshold value $\alpha$ in each of the main scanning direction and the sub-scanning direction is equal to or greater than a value predetermined in each of the main scanning direction and the sub-scanning direction.

In step S6, the processor 50 determines whether the image density at each pixel of the first halftone test toner image hIt1 is high (the image density at each pixel is higher than the average image density, and a difference between the average image density and the image density at each pixel is greater than the predetermined threshold value $\alpha$). Based on the determined result, the processor 50 determines whether the dark streak caused by the high image density at each pixel exists in the first halftone test toner image hIt1 in step S7. If the dark streak does not exist (NO in step S7), the processor 50 proceeds to step S9 described later. If the dark streak exists (YES in step S7), the processor 50 adjusts the optical writing power during the optical scan at the pixel on the photoconductor corresponding to the dark streak to a smaller optical writing power in step S8 and proceeds to step S9 described later. In step S7, the processor 50 determines the dark streak exists when the number of pixels in which the image density is higher than the average image density and the difference between the average image density and the image density of the pixel is greater than the threshold value $\alpha$ in each of the main scanning direction and the sub-scanning direction is equal to or greater than a value predetermined in each of the main scanning direction and the sub-scanning direction.

In step S9, the processor 50 determines whether the condition Y described above is satisfied. If the condition Y is not satisfied (NO in step S9), the processor 50 returns to step S1 described above. If the condition Y is satisfied (YES in step S9), the processor 50 proceeds to step S10.

In step S10, the second solid test toner image bIt2 and the second halftone test toner image hIt2 are formed and imaged. Subsequently, the processor 50 determines whether the image density at each pixel of the second solid test toner image bIt2 is low (the image density is lower than the average image density, and a difference between the average image density and the image density at each pixel is greater than the predetermined threshold value $\alpha$) in step S11. Based on the determined result, the processor 50 determines whether the white streak ws exists in the second solid test toner image bIt2 in step S12. If the white streak ws does not exist (NO in step S12), the processor 50 proceeds to step S14. If the white streak ws exists (YES in step S12), the processor 50 sets a flag of the white streak in step S13 and proceeds to step S14.

In step S14, the processor 50 determines whether the image density at each pixel of the second halftone test toner image hIt2 is high (the image density is higher than the average image density, and a difference between the average image density and the image density at each pixel is greater than the predetermined threshold value $\alpha$). Based on the determined result, the processor 50 determines whether the dark streak ds exists in the second halftone test toner image hIt2 in step S15. If the dark streak ds does not exist (NO in step S15), the processor 50 proceeds to step S17. If the dark streak ds exists (YES in step S15), the processor 50 sets a flag of the dark streak in step S16 and proceeds to step S17.

In step S17, the processor 50 determines whether at least one of the flag of the white streak and the flag of the dark streak is set. If both the flags are not set (NO in step S17), the processor 50 returns to step S1 described above. If at least one of the flags is set (YES in step S17), the processor 50 displays the error message corresponding to a situation of the flag on the control panel 65 in step S18, notifies the situation to the user, and returns to step S1.

In step S18, when only the flag of the white steak of the two flags is set, for example, the processor 50 displays the error message such as "A white streak occurs in the yellow image. Please request the repair to the maintenance organization". When only the flag of the dark steak is set, for example, the processor 50 displays the error message such as "A dark streak occurs in the yellow image. Please request the repair to the maintenance organization". When both the flags are set, for example, the processor 50 displays the error message such as "A white streak and a dark streak occur in the yellow image. Please request the repair to the maintenance organization".

When the number of the pixels on the photoconductor 1 in which the processor 50 adjusts the optical writing power in step S1 to step S8 is equal to or more than a predetermined value in some colors of yellow, magenta, cyan and black, that is, when the condition Y is satisfied in some colors (not satisfied in all colors), the processor 50 may perform steps from step S10 in only the colors in which the condition Y is satisfied without performing steps from step S10 in all colors, yellow, magenta, cyan, and black.

The processor 50 may perform steps from step S10 in only color that the user assigns based on a setting operation of the user when the condition Y is satisfied.

In the above embodiment, the processor 50 urges the user to request the repair to the maintenance organization as a countermeasure of the streaks when the white streak ws or the dark streak ds occurs. However, the countermeasure is not limited this. As long as the image forming apparatus 100 is checked, other countermeasure may be employed. For example, the processor may automatically send the request message of dispatch of an engineer to the maintenance organization by communication using telephone line. The processor may display the user a message that illustrates drawings and sentences explaining how to check the image forming apparatus 100 in detail and suggests the user to execute the check.

Example

Next, a description is given of an example in which a more specific configuration is given to the image forming apparatus 100 according to the embodiment. The configuration of an image forming apparatus 100 according to this example, which is not described, is the same as in the embodiment unless otherwise stated.

In addition to determine the occurrence of the white streak ws and the dark streak ds that extend in the sub-scanning direction, the processor 50 of the image forming apparatus 100 according to this example determines an occurrence of an abnormal cyclic image density that occurs in the sub-scanning direction cyclically in the regular routine control. As the abnormal cyclic image density, there are the abnormal cyclic image density that is caused by a local scratch or deterioration of the photoconductor surface, and occurs in a photoconductor rotational period, and the abnormal cyclic image density that is caused by a local scratch of the developing sleeve surface, and occurs in a developing sleeve rotational period. Additionally, there is the abnormal cyclic image density that is caused by a local scratch or deterioration of the charging roller surface, and occurs in a charging roller rotational period, too. When at least one of those abnormal cyclic image densities occurs, a request of repair is needed to exchange a part that causes the abnormal cyclic image density, that is, at least one of the photoconductor 1, the developing sleeve, and the charging roller.

However, a cyclic image density fluctuation may occur. The cyclic image density fluctuation is different from the above described abnormal cyclic image density, but occurs in the rotational period of the rollers or the sleeve. However, adjustment of the image forming condition can eliminate the occurrence of the cyclic image density fluctuation. For example, an error of an outside diameter or eccentricity of the photoconductor 1 or the developing sleeve causes a fluctuation of a developing gap between the photoconductor 1 and the developing sleeve. This results in the cyclic image density fluctuation in the photoconductor rotational period and the developing sleeve rotational period. Electrical resistance unevenness in the circumferential direction on the charging roller causes uneven charge of the photoconductor 1. This may result in the cyclic image density fluctuation in the charging roller rotational period. Cyclically changing the developing bias or the charging bias can eliminate these cyclic image density fluctuations. Therefore, detecting these cyclic image density fluctuations as the abnormal cyclic image density and notifying them to the user leads the user to request an unnecessary repair order.

In the present embodiment, the processor 50 adjusts cyclic pattern data that cyclically changes the developing bias and the charging bias as the image forming condition to eliminate the cyclic image density fluctuation, and, after that, determines whether the abnormal cyclic image density occurs. Specifically, the processor 50 controls the image density sensor 18 to image the first solid test toner image bIt1 and acquires the image data of the first solid test toner image bIt1. Based on the image data, the processor 50 determines whether the cyclic image density fluctuation in the sub-scanning direction occurs in the first solid test toner image bIt1. To detect the cyclic image density fluctuation in the photoconductor rotational period, the developing sleeve rotational period, and the charging roller rotational period, lengths of the first test toner image It1 and the second test toner image It2 in the sub-scanning direction is longer than a circumferential length of the photoconductor 1, the developing sleeve, and the charging roller.

When the processor 50 determines the cyclic image density fluctuation occurs in the first solid test toner image bIt1, the processor 50 generates a pattern data to cause a change of the developing bias that eliminates the cyclic image density fluctuation. For example, when there is the cyclic image density fluctuation occurring in the photoconductor rotational period, the processor 50 generates a pattern data changing the developing bias in the photoconductor rotational period to eliminate the cyclic image density fluctuation occurring in the photoconductor rotational period. When there is the cyclic image density fluctuation occurring in the developing sleeve rotational period, the processor 50 generates a pattern data changing the developing bias in the developing sleeve rotational period to eliminate the cyclic image density fluctuation occurring in the developing sleeve rotational period. When there is the cyclic image density fluctuation occurring in the charging roller rotational period, the processor 50 generates a pattern data changing the developing bias in the charging roller rotational period to eliminate the cyclic image density fluctuation occurring in the charging roller rotational period. After the processor 50 generates the pattern data, during an image forming process, the processor 50 cyclically changes the developing bias based on the pattern data.

Figure 12:
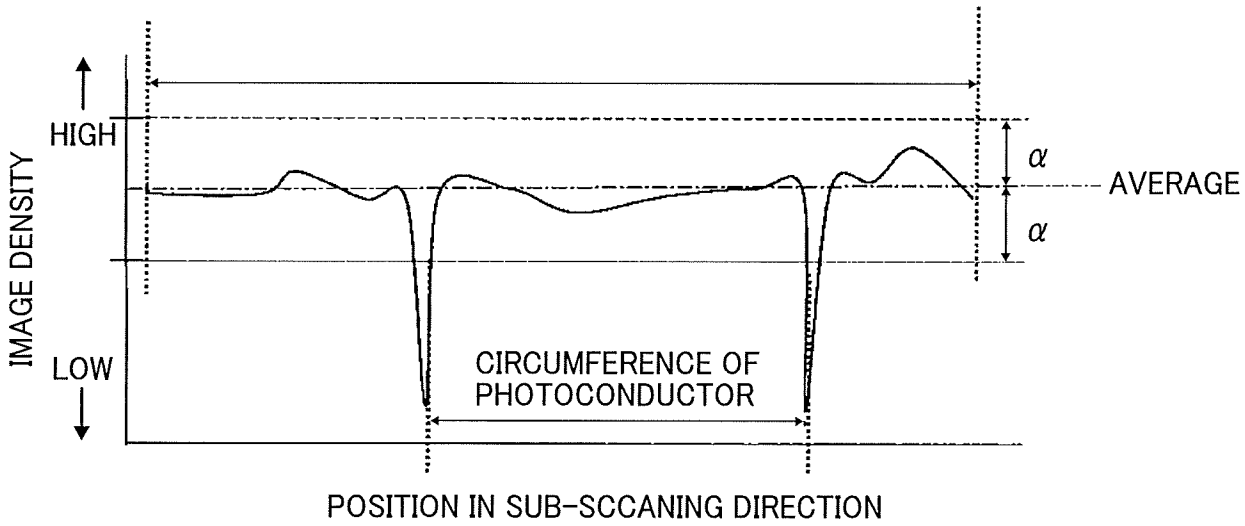
FIG. 12 is a graph illustrating an example of a relation between a position in a sub-scanning direction and an image density in a case of image density unevenness that occurs in a photoconductor rotational cycle.

For reference, FIG. 12 illustrates an example of a relation between a position in a sub-scanning direction and an image density in a case of the cyclic image density fluctuation occurring in the photoconductor rotational period.

The processor 50 cyclically changes the developing bias according to the pattern data in the photoconductor rotational period based on a timing when a photoconductor rotational attitude detector detects a standard rotational position of the photoconductor 1. The processor 50 cyclically changes the developing bias according to the pattern data in the developing sleeve rotational period based on a timing when a developing sleeve rotational attitude detector detects a standard rotational position of the developing sleeve. The processor 50 cyclically changes the developing bias according to the pattern data in the charging roller rotational period based on a timing when a charging roller rotational attitude detector detects a standard rotational position of the charging roller. When there are more than one pattern data in the above rotational periods, the processor superimposes the more than one pattern data.

A control of the developing bias enables the processor 50 to control the image density of the solid toner image.

Therefore, the processor 50 generates cyclically changing pattern data to change the developing bias cyclically based on the cyclic image density fluctuation in the first solid test toner image bIt1.

On the other hand, a control of the charging bias enables the processor 50 to control the image density of the halftone toner image. The processor 50 controls the image density sensor 18 to image the first halftone test toner image hIt1 and acquires the image data of the first halftone test toner image hIt1. Based on the image data, the processor 50 determines whether the cyclic image density fluctuation of the halftone image in the sub-scanning direction exists. When the cyclic image density fluctuation of the halftone image exists, the processor 50 generates a pattern data to cause a change of the charging bias that eliminate the cyclic image density fluctuation of the halftone image. For example, when there is a cyclic image density fluctuation of the halftone image occurring in the photoconductor rotational period, the processor 50 generates a pattern data changing the charging bias in the photoconductor rotational period to eliminate the cyclic image density fluctuation of the halftone image occurring in the photoconductor rotational period. When there is a cyclic image density fluctuation of the halftone image occurring in the developing sleeve rotational period, the processor 50 generates a pattern data changing the charging bias in the developing sleeve rotational period to eliminate the cyclic image density fluctuation of the halftone image occurring in the developing sleeve rotational period. When there is a cyclic image density fluctuation of the halftone image occurring in the charging roller rotational period, the processor 50 generates a pattern data changing the charging bias in the charging roller rotational period to eliminate the cyclic image density fluctuation of the halftone image occurring in the charging roller rotational period. After the processor 50 generates the pattern data, during an image forming process, the processor 50 cyclically changes the charging bias based on the pattern data.

For the halftone image, the processor 50 cyclically changes the charging bias according to the pattern data in the photoconductor rotational period based on a timing when a photoconductor rotational attitude detector detects a standard rotational position of the photoconductor 1. The processor 50 cyclically changes the charging bias according to the pattern data in the developing sleeve rotational period based on a timing when a developing sleeve rotational attitude detector detects a standard rotational position of the developing sleeve. The processor 50 cyclically changes the charging bias according to the pattern data in the charging roller rotational period based on a timing when a charging roller rotational attitude detector detects a standard rotational position of the charging roller. When there are more than one pattern data in the above rotational periods, the processor superimposes the more than one pattern data.

After the processor 50 generates the pattern data changing in the rotational periods, when a predetermined condition is satisfied, the processor 50 determines whether the abnormal cyclic image density exists. Specifically, the processor 50 determines whether the image density at each pixel of the second solid test toner image bIt2 is low. Based on the determined result, the processor 50 determines whether a cyclic white spot as the abnormal cyclic image density is in the second solid test toner image bIt2. When there is the cyclic white spot, the processor 50 sets a flag of the cyclic white spot and displays an error message illustrating an occurrence of the cyclic white spot (a countermeasure for the cyclic white spot).

Subsequently, the processor 50 determines whether the image density at each pixel of the second halftone test toner image hIt2 is high. Based on the determined result, the processor 50 determines whether a cyclic high image density as the abnormal cyclic image density is in the second halftone test toner image hIt2. When there is the cyclic high image density, the processor sets a flag of the cyclic high image density and displays an error message illustrating an occurrence of the cyclic high image density (a countermeasure for the cyclic high image density).

The image forming apparatus 100 described above shortens time from an occurrence of the cyclic white spot or the cyclic high image density to an end of repair that discover the cause of the cyclic white spot or the cyclic high image density and avoids leading the user to request an unnecessary repair order.

The first test toner image It1 and the second test toner image It2 to detect the white streak ws and the dark streak ds extending in the sub-scanning direction are the same as the first test toner image It1 and the second test toner image It2 to detect the abnormal cyclic image density. That is, using a set of the first test toner image It1 and the second test toner image It2, the processor 50 detects the white streak ws, the dark streak ds and the abnormal cyclic image density.

As described above, the lengths of the first test toner image It1 and the second test toner image It2 in the sub-scanning direction is longer than the circumferential length of the photoconductor 1, the developing sleeve, and the charging roller to detect the cyclic image density fluctuation in their rotational periods. Lengths of the first test toner image It1 and the second test toner image 1*t*2 in the main scanning direction are same in the rotational axial direction of the photoconductor 1. The processor 50 obtains the image densities of the first test toner image It1 and the second test toner image It2 at a predetermined interval in the main scanning direction and at a predetermined position in the sub-scanning direction to detect the white streak ws and the dark streak ds. Based on the obtained image densities, the processor 50 calculates the average image density of the image densities in the main scanning direction and the difference between the average image density and the image density at each position obtained at the predetermined interval.

To detect the abnormal cyclic image density in the sub-scanning direction, the processor 50 obtains the image densities of the first test toner image It1 and the second test toner image It2 at predetermined interval in the sub-scanning direction and at a predetermined position in the main scanning direction. Based on the obtained image densities, the processor 50 calculates the average image density of the image densities in the sub-scanning direction and the difference between the average image density and the image density at each position obtained at the predetermined interval.

When the processor 50 sets at least one of the flag of the white streak, the dark streak, the cyclic white spot, and the cyclic high image density, a manual operation of the user or service personnel who exchanges the part resets the flag. Data of the flag is stored in a non-volatile memory to be maintained even in the state of power OFF.

Additional Example

Next, a description is given of an additional example in which a more specific configuration is given to the image forming apparatus 100 according to the example. Furthermore, the configuration of an image forming apparatus 100 according to this additional example is the same as in the example unless otherwise stated.

The image forming apparatus 100 according to the embodiment, the example, and the additional example set an image forming position based on a center reference method. In the center reference method, regardless of a size of a print page in which the image is formed, a center position of the print page (that is, the recording sheet P) in the main scanning direction is set a center position of the photoconductor 1 in the rotational axial direction (the main scanning direction).

The image forming apparatus 100 according to the additional example can print the image on the recording sheet P whose size is A3 size at maximum. Therefore, a length of the intermediate transfer belt 8 in the width direction is slightly longer than a shorter length of A3 size. When the image is formed on the recording sheet P of A3 size, the recording sheet is transported with the sheet longitudinal direction along the sheet transporting direction. A center of a shorter side of the recording sheet P is set a center of the intermediate transfer belt 8 in the width direction. Similarly, a center of a shorter side of the recording sheet P of B4 size that is smaller than A3 size is set the center of the intermediate transfer belt 8 in the width direction. By contrast, the recording sheet P of A4 size or B5 size that is smaller than A4 size is transported with the shorter side along the sheet transporting direction. A center of a longer side of the recording sheet P of A4 size or B5 size is set the center of the intermediate transfer belt 8 in the width direction.

When the processor 50 of the image forming apparatus 100 according to the additional example sets the flag of the white streak as described above, the processor 50 stores position data of the white streak illustrating where the white streak occurs in an entire area in the width direction (the main scanning direction) of the intermediate transfer belt 8 in the non-volatile memory. When the processor 50 sets the flag of the dark streak, the processor 50 stores position data of the dark streak illustrating where the dark streak occurs in the entire area in the width direction of the intermediate transfer belt 8 in the non-volatile memory.

Figure 13A:
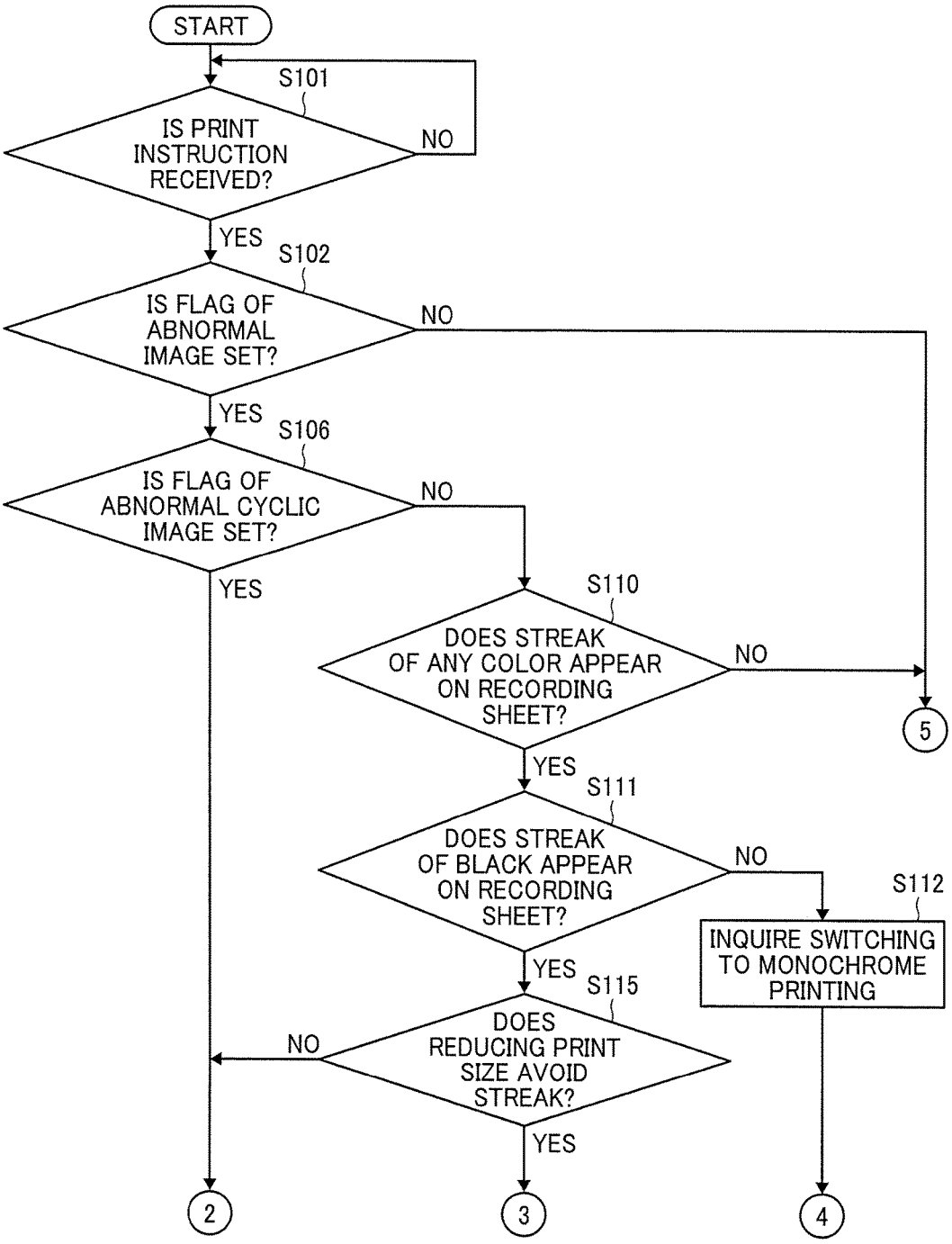
FIGS. 13A and 13B (collectively referred to as FIG. 13) are flowcharts illustrating steps in a process of a print job control and a determination control performed by a processor of the image forming apparatus according to an additional example.
Figure 13B:
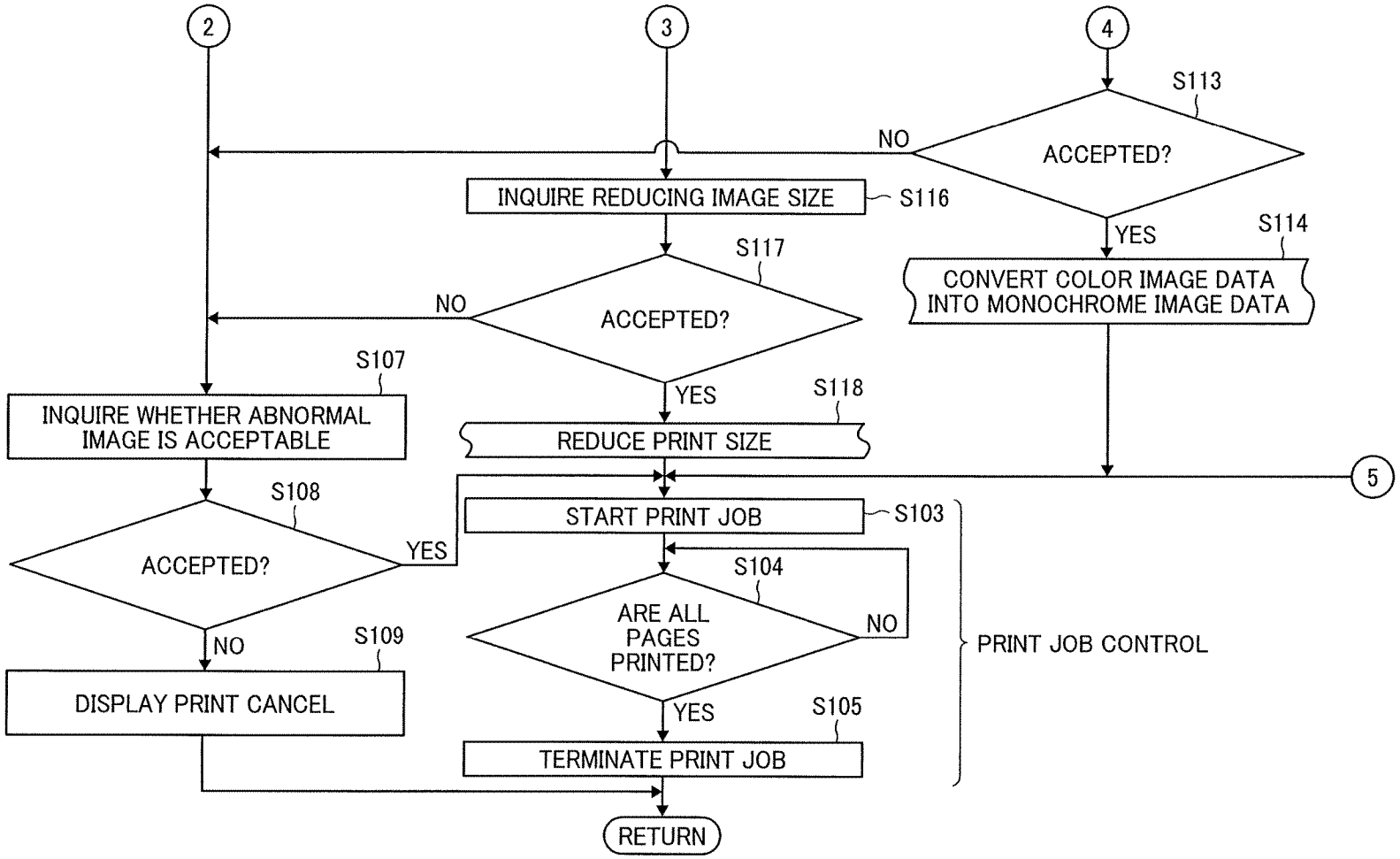

FIG. 13 is a flowchart illustrating steps in a process of a print job control and a determination control performed by the processor 50 of the image forming apparatus 100 according to the additional example. In FIG. 13, a sequence of steps S103, S104, and S105 is steps in the process of the print job control. Other steps illustrate the determination control. In the determination control, the processor 50 determines whether the processor 50 performs the print job. Depending on the determination results, the processor 50 terminates the sequence of the flow chart in FIG. 13, without performing the print job, even if the processor receives a print instruction.

The processor 50 that starts the determination control firstly waits until the processor receives the print instruction (NO in step S101). When the print instruction is sent by the user and the processor 50 receives the print instruction (YES in step S101), the processor 50 determines whether a flag of the abnormal image in any of colors, yellow, magenta, cyan, and black is set in step S102. The flag of the abnormal image is an inclusive term of the four flags described above, the flag of the white streak, the flag of the dark streak, the flag of the cyclic white spot, and the flag of the cyclic high image density. If at least one of the four flags is set in at least one of four colors, the processor 50 determines the flag of the abnormal image is set in step S102.

When the flag of the abnormal image is not set in all of yellow, magenta, cyan, and black (NO in step S102), the abnormal image does not occur in all colors. Therefore, the processor 50 proceeds steps from the determination control to the print job control to perform the print job based on the print instruction received in step 101.

In the print job control, the processor 50 starts driving various devices to start the print job in step S103. After an end of the print job of all pages (YES in step S104), the processor 50 stops driving various devices and terminates the print job in step S105 and finishes the print job control. After that, the processor 50 returns step S101 in the sequence of process flow and waits for a next print instruction.

On the other hand, when at least one of the four flags of the abnormal image such as the flag of the white streak, the flag of the dark streak, and others is set in at least one of colors (YES in step S102), the processor 50 determines whether the set flag of the abnormal image is a flag of the abnormal cyclic image in step S106. The flag of the abnormal cyclic image is an inclusive term of the two flags described above, that is, the flag of the cyclic white spot and the flag of the cyclic high image density. When at least one of the flags of the abnormal cyclic image exists in the set flag of the abnormal image, the processor 50 determines the flag of the abnormal cyclic image exists in step S106 (YES in step S106).

When the flag of the abnormal cyclic image is set (YES in step S106), the cyclic white spot or the cyclic high image density occurs in at least one of any color of yellow, magenta, cyan, and black. These abnormal cyclic images occur as image density fluctuations on the recording sheet P in the sub-scanning direction, synchronously with the rotational periods of the photoconductor 1, the developing sleeve, and the charging roller. A relatively long period of the abnormal cyclic image is about 10 to 20 centimeters. Because a length of the used recording sheet P in the sub-scanning direction is generally longer than the period of the abnormal cyclic image, the image density fluctuation of the abnormal cyclic image inevitably occurs on the recording sheet P as the cyclic white spot or the cyclic high image density. Therefore, when the flag of the abnormal cyclic image is set, the abnormal cyclic image inevitably occurs on the recording sheet P.

Figure 14:
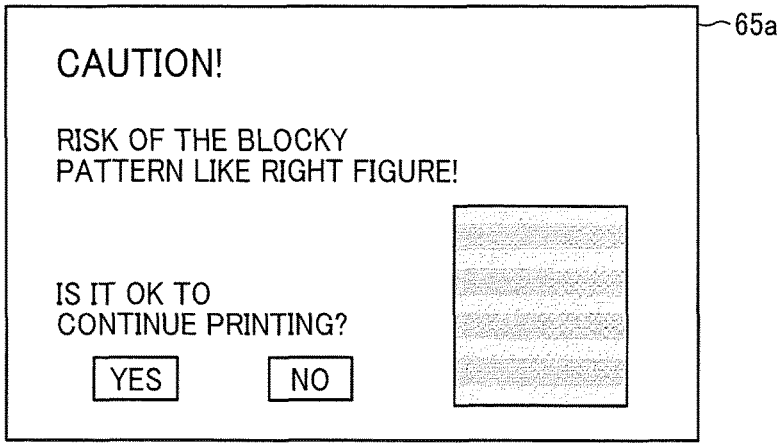
FIG. 14 is a schematic diagram illustrating a first example of a warning message that appears on the display of the control panel of the image forming apparatus illustrated in FIG. 13.

When the flag of the abnormal cyclic image is set (YES in step S106), the processor 50 performs a process to inquire of the user whether the abnormal image (the abnormal cyclic image) is acceptable in step S107. Specifically, as illustrated in FIG. 14, the processor 50 controls a display 65*a* (e.g., a touch panel) of the control panel 65 to display a message that notifies the user of a high possibility of occurrence of the abnormal cyclic image and inquires of the user whether or not the print job may be performed. When the user who confirms the message presses a YES button on the display 65*a*, the processor 50 receives print permission information (YES in step 108 of FIG. 13), proceeds steps from the determination control to the print job control (steps S103 to S105), and performs the print job control. By contrast, when the user presses a NO button on the display 65*a*, the processor 50 receives print stop information (NO in step S108), controls the display 65*a* of the control panel 65 to display a message, for example, "Print instruction is cancelled", in step S109, and returns step S101 in the sequence of process flow.

On the other hand, when the flags of the abnormal cyclic image do not exist in the set flag of the abnormal image (NO in step S106), the set flag of the abnormal image is the flag of the white streak, the flag of the dark streak, or the both. That is, the white streak ws, the dark streak ds, or the both occur on the intermediate transfer belt 8. However, when the white streak ws and the dark streak ds occur on the intermediate transfer belt 8, there is a case that the streak is not secondarily transferred onto the recording sheet P. For, example, in an example illustrated in FIG. 15, the white streak ws and the dark streak ds on the intermediate transfer belt 8 are secondarily transferred onto the recording sheet P of A3 size or A4 size, but not secondarily transferred onto the recording sheet P of B4 size or B5 size.

Figure 15:
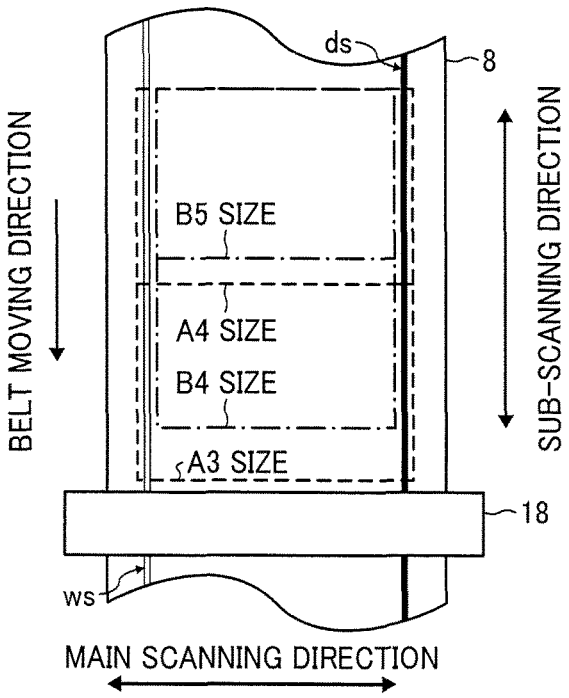
FIG. 15 is an explanatory diagram illustrating a relation between a recording sheet size and positions of a white streak and a dark streak occurring on the intermediate transfer belt of the image forming apparatus illustrated in FIG. 13.

The example illustrated in FIG. 15 is described in further detail below. With reference to FIG. 15, the white streak ws and the dark streak ds occur near the end of the intermediate transfer belt 8 in the width direction (the main scanning direction). Positions where the white streak ws and the dark streak ds occur overlap with an end portion of the recording sheet P, which tightly contacts the intermediate transfer belt 8 in the secondary-transfer nip, in a longitudinal direction of A4 size and a transverse direction of A3 size. Therefore, the white streak ws and the dark streak ds on the intermediate transfer belt 8 are secondarily transferred onto the recording sheet P of A3 size and A4 size. That is, the white streak ws and the dark streak ds on the intermediate transfer belt 8 appear on the recording sheet P of A3 size and A4 size. When the recording sheet P of A3 size or A4 size is used, in an entire portion of the intermediate transfer belt 8 in FIG. 15, one of the positions where the white streak ws or the dark streak ds occurs corresponds to a transfer position where the white streak ws or the dark streak ds is secondarily transferred to the recording sheet P.

On the other hand, positions where the white streak ws and the dark streak ds occur on the intermediate transfer belt 8 in the main scanning direction do not overlap with the recording sheet P of B4 size and B5 size, which tightly contacts the intermediate transfer belt 8 in the secondary-transfer nip. Therefore, the white streak ws and the dark streak ds occurring on the intermediate transfer belt 8 are not secondarily transferred onto the recording sheet P of B4 size and B5 size. That is, the white streak ws and the dark streak ds on the intermediate transfer belt 8 do not appear on the recording sheet P of B4 size and B5 size. When the recording sheet P of B4 size or B5 size is used, in an entire portion of the intermediate transfer belt 8 in FIG. 15, the positions where the white streak ws or the dark streak ds occurs correspond to a non-transfer position where the white streak ws and the dark streak ds are not secondarily transferred to the recording sheet P.

Even if the white streak ws or the dark streak ds is at the position where the white streak ws or the dark streak ds appears on the recording sheet P, when the white streak ws or the dark streak ds is due to the device failure in the at least one of the color process units 6Y, 6M, and 6C, it is possible to avoid the streak by doing the following. That is, the processor 50 switches from color printing to monochrome printing, and outputs the image.

When the abnormal cyclic image does not occur but the white streak ws or the dark streak ds occurs on the intermediate transfer belt 8 (NO in step S106 of FIG. 13), the processor 50 determines whether the white streak ws or the dark streak ds appears on the recording sheet P in step S110. At this time, if the white streak ws or the dark streak ds in each of some colors occurs on the intermediate transfer belt 8, the processor 50 determines whether the white streak ws or the dark streak ds in each color appears on the recording sheet P.

In this determination, when the white streak ws and the dark streak ds on the intermediate transfer belt 8 in any color do not appear on the recording sheet P (NO in step S110), any of the abnormal cyclic image, the white streak, and the dark streak does not appear on the recording sheet P. Therefore, the processor 50 proceeds to step S103 to start the print job control.

Figure 16:
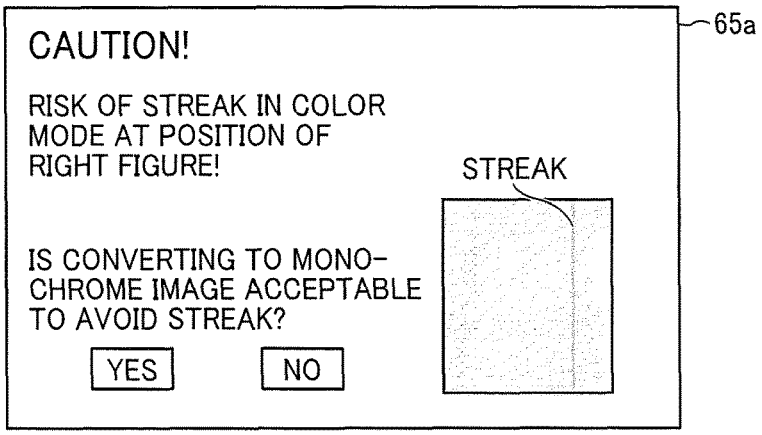
FIG. 16 is a schematic diagram illustrating a second example of a warning message that appears on the display of the control panel of the image forming apparatus illustrated in FIG. 13.

On the other hand, when the white streak ws or the dark streak ds on the intermediate transfer belt 8 appears on the recording sheet P (YES in step S110), the processor 50 determines whether the white streak ws or the dark streak ds in the black image appears on the recording sheet P in step S111. When the white streak ws and the dark streak ds do not occur in the black image (NO in step S110), that is, the white streak ws or the dark streak ds occurs in any of the colors, yellow, magenta, and cyan, performing monochrome printing and stopping color printing avoid the occurrence of the white streak ws and the dark streak ds. When the white streak ws and the dark streak ds in the black image do not occur on the recording sheet P (NO in step S111), the processor 50 performs a process to inquire of the user whether switching from the color printing to the monochrome printing is acceptable in step S112. Specifically, as illustrated in FIG. 16, the processor 50 controls the display 65*a* to display a message that notifies the user of a high possibility of occurrence of the streak in the full color mode and inquires of the user whether or not converting from a color image to a black image to avoid the occurrence of the streak is acceptable. When the user who confirms the message presses a YES button on the display 65*a*, the processor 50 receives print permission information (YES in step 113 of FIG. 13), performs a process that converts original image data received from the personal computer or the like into monochrome image data, and converts color image data into monochrome image data in step S114. The processor performs the print job control (steps S103 to S105) based on the monochrome image data.

On the other hand, when the user inputs information that informs the monochrome image is not acceptable (NO in step S113), the processor 50 advances the process flow to step S107, and performs the process to inquire of the user whether the abnormal image (the streak) is acceptable in step S107. In this inquiry, the processor 50 controls the display 65*a* to display a warning message illustrated in FIG. 17 instead of a warning message illustrated in FIG. 14. In the warning message illustrated in FIG. 14, the displayed message notifies the user of the high possibility of occurrence of the abnormal cyclic image (a blocky pattern). Alternatively, in the warning message illustrated in FIG. 17, the displayed message notifies the user of the high possibility of occurrence of the streak. When the user who confirms the warning message presses a YES button on the display 65*a*, the processor 50 receives print permission information (YES in step 108 of FIG. 13), and performs the print job control described above. When the user presses a NO button on the display 65*a*, the processor 50 receives print stop information (NO in step S108), permits the display 65*a* of the control panel 65 to display a message, for example, "Print instruction is cancelled" in step S109, and returns step S101 in the sequence of processing flow.

Figure 18:
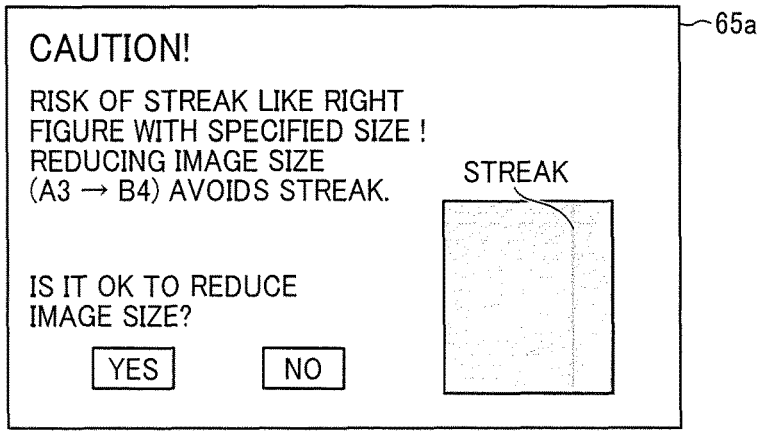
FIG. 18 is a schematic diagram illustrating a third example of a warning message that appears on the display of the control panel of the image forming apparatus illustrated in FIG. 13.

When the processor 50 determines the white streak ws or the dark streak ds occurs in the black image in step S111 described above (YES in step S111), printing the black image does not prevent the occurrence of the white streak ws and the dark streak ds. However, as the example illustrated in FIG. 15, reduction from A3 size to B4 size or from A4 size to B5 size, i.e., reducing a print size may avoid the occurrence of the streak. Therefore, the processor 50 determines whether reducing the print size prevents the occurrence of the streak in step S115. When the streak does not occur (YES in step S115), the processor 50 performs a process to inquire of the user whether reducing an image size from an original size is acceptable in step S116. Specifically, as illustrated in FIG. 18, the processor 50 controls the display 65*a* to display a message that notifies the user of a high possibility of occurrence of the streak in the original size and inquires of the user whether or not reducing the image size from the original size to avoid the occurrence of the streak is acceptable. When the user who confirms the warning message presses a YES button on the display 65*a*, the processor 50 receives print permission information (YES in step 117 of FIG. 13). In this case, the processor 50 converts the original image data received from the personal computer or the like into reduced image data to reduce the original page size to the small size (for example, A3 to B4) in step S118. The processor performs the print job control (steps S103 to S105) based on the converted image data.

Figure 17:
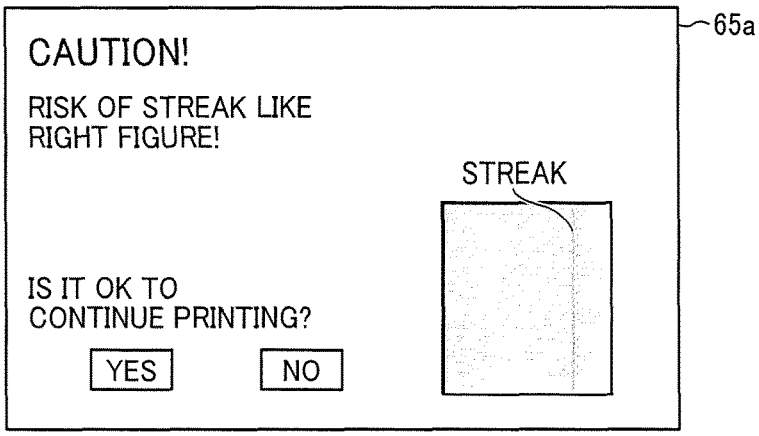
FIG. 17 is a schematic diagram illustrating a third example of a warning message that appears on the display of the control panel of the image forming apparatus illustrated in FIG. 13.

On the other hand, when the user inputs information that informs reducing the image size is not acceptable (NO in step S117), the processor 50 advances the process flow to step S107 described above, and controls the display 65*a* to display the warning message illustrated in FIG. 17. The subsequent processes are described above.

In the above described process flow, when the user issues the print instruction (YES in step S101 of FIG. 13) before maintenance of the image forming apparatus 100 after the occurrence of the abnormal images such as the white streak ws and other abnormal images, the processor 50 performs a condition determination process that determines whether the predetermined condition is satisfied. When the processor 50 determines the predetermined conditions is satisfied, the processor 50 performs the print job control based on the print instruction. In the present embodiment, even if the abnormal image such as the white streak ws, the dark streak ds, the cyclic white spot, the cyclic high image density, and the like occurs, the processor 50 performs the print job control when the processor 50 receives the print permission information from the user (when the predetermined condition is satisfied). This enables provision of the image to the user who knows the occurrence of the abnormal image but requests the provision of the image.

When, as the predetermined condition, the condition in which the streaked image such as the white streak ws or the like is formed on a non-transfer position on the intermediate transfer belt 8 from which the streaked image is not secondarily transferred onto the recording sheet P is satisfied (NO in step S110), the processor 50 performs the print job control. In this case, even if the streaked image occurs on the intermediate transfer belt 8, because the streaked image does not appear on the recording sheet P, the processor 50 performs the print job control. This enables provision of the image without the abnormal image to the user, and provides the user's convenience.

When, as the predetermined condition, the condition in which the user inputs the print permission information on the control panel 65 to perform the print job control based on the print instruction is satisfied (YES in step S108), the processor 50 also performs the print job control. This enables the processor 50 to perform the print job control and provide the image to the user who accepts the occurrence of the streaked image such as the white streak ws and the like, and provides the user's convenience.

Additionally, when the streaked image occurs on the intermediate transfer belt 8 in formation of the color image that is an original image, but does not occur in the monochrome image converted form the color image, the processor 50 inquires of the user whether converting from the color image to the black image is acceptable in step S112 When the user who confirms the inquiry inputs the print permission information (YES in step 113), the processor 50 performs the print job control. This enables the processor 50 to provide the image in the changed color to the user who accepts change of the color of the original image, and provides the user's convenience.

Additionally, when the streaked image occurs on the recording sheet P in an image formation based on the original image data, but does not occur on the recording sheet P smaller than the original recording sheet P in which the original image is reduced in size (YES in step S115), the processor 50 inquires of the user whether reducing an image size from an original size is acceptable in step S116. When the user who confirms the inquiry inputs the print permission information (YES in step 117), the processor 50 performs the print job control. This enables the processor 50 to provide the image with the reduced size to the user who accepts reducing the image size from the original size, and provides the user's convenience.

The exemplary embodiments described above are one example and attain advantages below in a plurality of aspects A to O.

Aspect A

In aspect A, an image forming apparatus includes an image forming device to form a first test toner image and a second test toner image (for example, the set of the process units 6Y, 6M, 6C, and 6K and the optical writing unit 20), an image density detector (for example, the image density sensor 18) to detect an image density at a plurality of positions of the first test toner image and the second test toner image formed by the image forming device; and a processor (for example, the processor 50) configured to control the image forming device to form a first test toner image, control the image density detector to detect the image density at the plurality of positions of the first test toner image, adjust an image forming condition (for example, the optical writing power) of the image forming device so that the image density at each of the plurality of positions becomes a target image density, control the image forming device to form a second test toner image based on the adjusted image forming condition, control the image density detector to detect the image density at the plurality of positions of the second test toner image, determine whether a streaked image (for example, the white streak ws and the dark streak ds) exists in the second test toner image based on the image density detected at the plurality of positions of the second test toner image by the image density detector, and execute a countermeasure to prevent an occurrence of the streaked image based on a determined result of the streaked image in the second test toner image.

In the aspect A, the processor adjusts the image forming condition so that the image density becomes the target image density based on the image density detected at the plurality of positions of the first test toner image before the processor determines whether the streaked image exists in the second test toner image. When the first test toner image does not include the streaked image that is due to device malfunction, and includes the streaky image density deviation that can be eliminated by adjusting the image forming condition, the processor adjusts the image forming condition to eliminate the streaky image density deviation. After the adjustment, the processor forms the second test toner image based on the adjusted image forming condition. The adjusted image forming condition immediately before forming the second test toner image rarely causes the streaky image density deviation that can be eliminated by adjusting the image forming condition in the second test toner image. Therefore, in the second test toner image, it is extremely rare that the streaky image density deviation that can be eliminated by adjusting the image forming condition is erroneously detected as the streaked image that is due to device malfunction. Determining whether the streaked image that is due to device malfunction exists based on the results of the image density detected in the second test toner image eliminates erroneous detection of the image density deviation that can be eliminated by adjusting the image forming condition as the streaked image that is due to device malfunction. This makes it possible to perform the countermeasure preventing a formation of an image including the streaked image unnecessarily.

Aspect B

In aspect B, the processor of the image forming apparatus according to the aspect A, when the processor adjusts the image forming condition, calculates an average value obtained by averaging the image density at the plurality of positions of the first test toner image and an image density difference between the calculated average value and the image density at each of the plurality of positions of the first test toner image, sets the image density at which the image density difference is less than a predetermined threshold value or equal to or less than a predetermined threshold value as the target image density, adjusts the image forming condition to decrease the image density deference at a position where the image density deference is greater than or equal to the predetermined threshold value, or greater than the predetermined threshold value. This avoids cumbersome control that controls unnoticeable level of image density.

Aspect C

In aspect C, the processor of the image forming apparatus according to the aspect B, when the processor determines whether the streaked image exists in the second test toner image, calculates an average value obtained by averaging the image density at the plurality of positions of the second test toner image and an image density difference between the calculated average value and the image density at each of the plurality of positions of the second test toner image, and determines whether the streaked image exists based on an existence of a position where the image density difference is greater than or equal to a predetermined threshold value, or greater than a predetermined threshold value. The processor described above can detect the streaked image accurately by employing a following condition as a criterion for determining. The criterion is that an image density difference between an average image density of the first test toner image and the image density at each of the plurality positions of the first test toner image is greater than the predetermined threshold value or greater than or equal to the predetermined threshold value, and an image density difference between an average image density of the second test toner image and the image density at each of the plurality positions of the second test toner image is greater than the predetermined threshold value or greater than or equal to the predetermined threshold value.

Aspect D

In aspect D, the processor of the image forming apparatus according to the aspect B controls the image forming device to form the second test toner image having the same image density as the first test toner image. The processor described above avoids deterioration of accuracy of determining whether the streaked image exists in the second test toner image, which is caused by setting the image density of the second test toner image different from the image density of the first test toner image.

Aspect E

In aspect E, the processor of the image forming apparatus according to the aspect D controls the image forming device to form a high density first test toner image with a high image density and a low density first test toner image with a low image density that is lower than the high image density, determines whether the image density at each of the plurality of positions of the high density first test toner image is lower than a predetermined condition based on results detected by the image density detector that detects the high density first test toner image, and whether the image density at each of the plurality of positions of the low density first test toner image is higher than a predetermined condition based on results detected by the image density detector that detects the low density first test toner image. The processor described above can accurately detect an occurrence of low image density portion like the streak and an occurrence of high image density portion like the streak compared with a case in which the first test toner image is only either the low density first test toner image or the high density first test toner image.

Aspect F

In aspect F, the processor of the image forming apparatus according to the aspect E controls the image forming device to form a high density second test toner image with the high image density of the high density first test toner image and a low density second test toner image with the low image density of the low density first test toner image, determines whether the streaked image at which the image density is lower than a predetermined condition exists at each of the plurality of positions of the high density second test toner image based on results detected by the image density detector that detects the high density second test toner image, and whether the streaked image at which the image density is higher than a predetermined condition exists at each of the plurality of positions of the low density second test toner image based on results detected by the image density detector that detects the low density second test toner image. The processor described above can accurately determine whether the abnormal image with low image density exists in the second test toner image, and whether the abnormal image with high image density exists in the second test toner image, compared with a case in which the second test toner image is only either the low density second test toner image or the high density second test toner image.

Aspect G

In aspect G, the image forming apparatus according to the aspect A includes an image bearer (for example, the intermediate transfer belt 8), rotatable in a rotation direction, to bear the first test toner image, the second test toner image and a toner image based on image data formed by the image forming device and a transfer device (for example, the transfer unit 7) to transfer the toner image based on the image data from the image bearer to a sheet. Additionally, the image density detector detects the image density of the first test toner image and the second test toner image on the image bearer. The image forming apparatus described above can detect the image density of the first test toner image and the second test toner image without transferring the first test toner image and the second test toner image from the image bearer to the sheet. Therefore, consuming the sheet only to detect the image density is not needed. Useless resource consumption is avoided.

Aspect H

In aspect H, the processor of the image forming apparatus according to the aspect G determines whether an abnormal image extending in the rotation direction (for example, the sub-scanning direction) of the image bearer exists as the streaked image. The processor described above can detect the occurrence of the streaked image extending in the rotation direction early.

Aspect I

In aspect I, the processor of the image forming apparatus according to the aspect H determines whether an abnormal cyclic image density that occurs in the rotation direction of the image bearer cyclically exists. The processor described above can detect the occurrence of the abnormal image that has periodicity in the rotation direction early.

Aspect J

In aspect J, the image forming device of the image forming apparatus according to the aspect I includes a latent image bearer rotatable in a rotation direction (for example, the photoconductor 1Y, 1M, 1C, and 1K), a latent image forming unit (for example, the optical writing unit 20) to form a latent image on the latent image bearer, and a developing unit (for example, the developing device 5Y, 5M, 5C, and 5K) including a developer bearer (for example, the developing sleeve), being rotatable in a rotation direction, to bear a developer. The developing unit develops the latent image with the developer into each of the first test toner image and the second test toner image. Additionally, a length of the first test toner image and the second test toner image in the rotation direction of the latent image bearer is longer than each of a circumference of the latent image bearer in the rotation direction of the latent image bearer and a circumference of the developer bearer in the rotation direction of the developer bearer. The image forming apparatus described above can certainly detect the image density fluctuation occurring in the rotational period of the latent image bearer and the developer bearer in the first test toner image and the second test toner image.

Aspect K

In aspect K, the image forming apparatus according the aspect A includes an information notification device (for example, the control panel 65) to issue a warning message. Additionally, the processor controls the information notification device to issue the warning message to urge a maintenance of the image forming apparatus based on the determination result of existence of the streaked image (for example, step S18 in FIG. 11) as the countermeasure. The processor determines whether a predetermined condition is satisfied if the processor receives an image forming instruction (for example, the print instruction, step S1 in FIG. 13) after issuing the warning message and before the maintenance, and performs an image forming based on the image forming instruction if the processor determines that the predetermined condition is satisfied (for example, steps in FIG. 13 other than step S3 to S5). In the above described image forming apparatus, even if the streaked image occurs, the processor performs the print job control, for example, when the processor receives the print permission information, a print order, or something like that from the user (when the predetermined condition is satisfied), and makes it possible to provide the image to the user.

Aspect L

In aspect L, the image forming apparatus according to the aspect K includes an image bearer to bear the toner image based on image data formed by the image forming device, and a transfer device to transfer the toner image based on the image data from the image bearer onto a sheet. Additionally, the predetermined condition is that a position of the streaked image on the image bearer is a non-transfer position where the streaked image is not transferred onto the sheet. In this case, even if the streaked image occurs on the image bearer, when the streaked image does not appear on the recording sheet, the image forming apparatus performs an image forming action and makes it possible to provide the image without the abnormal image. This increases convenience.

Aspect M

In aspect M, the image forming apparatus according to the aspect L includes an information input device to receive the image forming instruction. Additionally, the predetermined condition is that the information input device receives permission that permits the image forming device to perform the image forming based on the image forming instruction. The image forming apparatus described above performs the image forming action, provides the image to the user who accepts the occurrence of the abnormal image, and increase convenience.

Aspect N

In aspect N, the image forming device of the image forming apparatus according to the aspect M includes a plurality of latent image bearers (for example, the photoconductors 1Y, 1M, 1C, and 1K) to bear a plurality of toner images in different colors, respectively. When an original color image formed based on original image data of a predetermined color includes the streaked image and another color image formed based on image data obtained by converting the original color to the another color does not include the streaked image, the processor controls the information notification device to issue an inquiry that inquires whether changing from the predetermined color to the another color is acceptable. Additionally, the predetermined condition is that the information input device receives the permission to change from the predetermined color to the another color after the information notification device issues the inquiry. This enables the processor 50 to provide the image changed color to the user who accepts changing color from the original image, and provides the user's convenience.

Aspect O

In aspect O, the processor of the image forming apparatus according to the aspect M, when the toner image formed and transferred onto the sheet of a predetermined size based on original image data includes the streaked image and the toner image formed and transferred onto the sheet of a reduced size smaller than the predetermined size based on another image data that reduces the toner image from the predetermined size to the reduced size does not include the streaked image, the processor controls the information notification device to issue an inquiry that inquires whether reducing the predetermined size is acceptable. Additionally, the predetermined condition is that the information input device receives the permission to reduce the predetermined size after the information notification device issues the inquiry. This enables the processor to provide the image reduced the size to the user who accepts reducing the image size from the original size, and provides the user's convenience.

Aspect P

In aspect P, an image forming method includes forming a first test toner image, detecting an image density at a plurality of positions of the first test toner image, adjusting an image forming condition so that the image density at each of the plurality of positions of the first test toner image becomes a target image density, forming a second test toner image based on the adjusted image forming condition, detecting an image density at the plurality of positions of the second test toner image, determining whether a streaked image exists in the second test toner image based on the image density detected at the plurality of positions of the second test toner image, and executing a countermeasure to prevent an occurrence of the streaked image based on a determined result of the streaked image in the second test toner image. This method avoids performing the unnecessary countermeasure as in the aspect A.

What is claimed is:

1. An image forming apparatus comprising:

an image forming device to form a first test toner image and a second test toner image;

an image density detector to detect an image density at a plurality of positions of the first test toner image and the second test toner image formed by the image forming device; and a processor configured to:

control the image forming device to form the first test toner image, control the image density detector to detect the image density at the plurality of positions of the first test toner image, adjust an image forming condition of the image forming device so that the image density at each of the plurality of positions becomes a target image density, control the image forming device to form the second test toner image based on the adjusted image forming condition, control the image density detector to detect the image density at the plurality of positions of the second test toner image, determine whether a streaked image exists in the second test toner image based on the image density detected at the plurality of positions of the second test toner image by the image density detector, and execute a countermeasure to prevent an occurrence of the streaked image based on a determined result of the streaked image in the second test toner image.

2. The image forming apparatus according to claim 1, wherein, when the processor adjusts the image forming condition, the processor:

calculates an average value obtained by averaging the image density at the plurality of positions of the first test toner image and an image density difference between the calculated average value and the image density at each of the plurality of positions of the first test toner image, sets the image density at which the image density difference is less than a predetermined threshold value or equal to or less than a predetermined threshold value as the target image density, and adjusts the image forming condition to decrease the image density difference at a position where the image density difference is greater than or equal to the predetermined threshold value, or greater than the predetermined threshold value.

3. The image forming apparatus according to claim 2, wherein, when the processor determines whether the streaked image exists in the second test toner image, the processor:

calculates an average value obtained by averaging the image density at the plurality of positions of the second test toner image and an image density difference between the calculated average value and the image density at each of the plurality of positions of the second test toner image, and determines whether the streaked image exists based on an existence of a position where the image density difference is greater than or equal to a predetermined threshold value, or greater than a predetermined threshold value.

4. The image forming apparatus according to claim 2, wherein the processor controls the image forming device to form the second test toner image having the same image density as the first test toner image.

5. The image forming apparatus according to claim 4, wherein the processor:

controls the image forming device to form a high density first test toner image with a high image density and a low density first test toner image with a low image density that is lower than the high image density, and determines whether the image density at each of the plurality of positions of the high density first test toner image is lower than a predetermined condition based on results detected by the image density detector that detects the high density first test toner image, and whether the image density at each of the plurality of positions of the low density first test toner image is higher than a predetermined condition based on results detected by the image density detector that detects the low density first test toner image.

6. The image forming apparatus according to claim 5, wherein the processor:

controls the image forming device to form a high density second test toner image with the high image density of the high density first test toner image and a low density second test toner image with the low image density of the low density first test toner image, and determines whether the streaked image at which the image density is lower than a predetermined condition exists at each of the plurality of positions of the high density second test toner image based on results detected by the image density detector that detects the high density second test toner image, and whether the streaked image at which the image density is higher than a predetermined condition exists at each of the plurality of positions of the low density second test toner image based on results detected by the image density detector that detects the low density second test toner image.

7. The image forming apparatus according to claim 1, further comprising:

an image bearer, rotatable in a rotation direction, to bear the first test toner image, the second test toner image, and a toner image based on image data formed by the image forming device; and a transfer device to transfer the toner image based on the image data from the image bearer onto a sheet, wherein the image density detector detects the image density of the first test toner image and the second test toner image on the image bearer.

8. The image forming apparatus according to claim 7, wherein the processor determines whether an abnormal image extending in the rotation direction of the image bearer exists as the streaked image.

9. The image forming apparatus according to claim 8, wherein the processor determines whether an abnormal cyclic image density that occurs in the rotation direction of the image bearer cyclically exists.

10. The image forming apparatus according to claim 9, wherein the image forming device includes:

a latent image bearer rotatable in a rotation direction;

a latent image forming unit to form a latent image on the latent image bearer; and a developing unit including a developer bearer, being rotatable in a rotation direction, to bear a developer, the developing unit to develop the latent image with the developer into each of the first test toner image and the second test toner image, and wherein a length of each of the first test toner image and the second test toner image in the rotation direction of the latent image bearer is longer than each of a circumference of the latent image bearer in the rotation direction of the latent image bearer and a circumference of the developer bearer in the rotation direction of the developer bearer.

11. The image forming apparatus according to claim 1, further comprising an information notification device to issue a warning message, wherein the processor controls the information notification device to issue the warning message to urge a maintenance of the image forming apparatus based on the determination result of existence of the streaked image as the countermeasure, wherein the processor determines whether a predetermined condition is satisfied if the processor receives an image forming instruction after issuing the warning message and before the maintenance, and wherein the processor performs an image forming based on the image forming instruction if the processor determines that the predetermined condition is satisfied.

12. The image forming apparatus according to claim 11, further comprising:

an image bearer to bear a toner image based on image data formed by the image forming device; and a transfer device to transfer the toner image based on the image data from the image bearer onto a sheet, wherein the predetermined condition is that a position of the streaked image on the image bearer is a non-transfer position where the streaked image is not transferred onto the sheet.

13. The image forming apparatus according to claim 12, further comprising:

an information input device to receive the image forming instruction, wherein the predetermined condition is that the information input device receives permission that permits the image forming device to perform the image forming based on the image forming instruction.

14. The image forming apparatus according to claim 13, wherein the image forming device includes a plurality of latent image bearers to bear a plurality of toner images in different colors, respectively, when an original color image formed based on original image data of a predetermined color includes the streaked image and another color image formed based on image data obtained by converting the original color to another color does not include the streaked image, the processor controls the information notification device to issue an inquiry that inquires whether changing from the predetermined color to the another color is acceptable, and wherein the predetermined condition is that the information input device receives the permission to change from the predetermined color to the another color after the information notification device issues the inquiry.

15. The image forming apparatus according to claim 13, wherein, when the toner image formed and transferred onto the sheet of a predetermined size based on original image data includes the streaked image and the toner image formed and transferred onto the sheet of a reduced size smaller than the predetermined size based on another image data that reduces the toner image from the predetermined size to the reduced size does not include the streaked image, the processor controls the information notification device to issue an inquiry that inquires whether reducing the predetermined size is acceptable, and wherein the predetermined condition is that the information input device receives the permission to reduce the predetermined size after the information notification device issues the inquiry.

16. An image forming method comprising:

forming a first test toner image;

detecting an image density at a plurality of positions of the first test toner image;

adjusting an image forming condition so that the image density at each of the plurality of positions of the first test toner image becomes a target image density;

forming a second test toner image based on the adjusted image forming condition;

detecting the image density at the plurality of positions of the second test toner image;

determining whether a streaked image exists in the second test toner image based on the image density detected at the plurality of positions of the second test toner image; and executing a countermeasure to prevent an occurrence of the streaked image based on a determined result of the streaked image in the second test toner image.

* * * * *